US006283650B1

(12) United States Patent
Yamada et al.

(10) Patent No.: US 6,283,650 B1
(45) Date of Patent: Sep. 4, 2001

(54) PRINTING DEVICE HAVING AN OUTPUT LEVEL COMPENSATION FUNCTION

(75) Inventors: Akitoshi Yamada; Hiromitsu Hirabayashi, both of Irvine, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/901,561

(22) Filed: Jul. 28, 1997

(51) Int. Cl.[7] ..... B41J 2/315; B41J 29/38
(52) U.S. Cl. ..... 400/120.14; 347/14; 347/60
(58) Field of Search ..... 400/120.14; 347/14, 347/60

(56) References Cited

U.S. PATENT DOCUMENTS

| | | | | |
|---|---|---|---|---|
| 4,272,771 | | 6/1981 | Furukawa | 346/75 |
| 5,166,699 | | 11/1992 | Yano et al. | 346/1.1 |
| 5,367,325 | | 11/1994 | Yano et al. | 347/17 |
| 5,427,461 | | 6/1995 | Hirai et al. | 400/279 |
| 5,477,246 | | 12/1995 | Hirabayashi et al. | 347/12 |
| 5,485,179 | * | 1/1996 | Otsuka et al. | 346/140 R |
| 5,493,319 | | 2/1996 | Hirabayashi et al. | 347/29 |
| 5,559,535 | * | 9/1996 | Otsuka et al. | 347/14 |
| 5,751,304 | * | 5/1998 | Hirabayashi et al. | 347/17 |
| 5,760,797 | * | 6/1998 | Koizumi et al. | 347/14 |

FOREIGN PATENT DOCUMENTS 50-81437 11/1974 (JP) .

* cited by examiner

*Primary Examiner*—John S. Hilten
*Assistant Examiner*—Charles H. Nolan, Jr.
(74) *Attorney, Agent, or Firm*—Fitzpatrick, Cella, Harper & Scinto

(57) ABSTRACT

A printing device having multiple printheads includes an acquisition device to obtain temperatures of the multiple printheads, a determination device which determines, based on the obtained temperature of one printhead, a target temperature corresponding to each other of the multiple printheads in order to maintain a predetermined output level relationship between an output level of the one printhead and an output level of each other of the multiple printheads, and an adjustment device to adjust the temperature of each other of the multiple printheads to the corresponding target temperature.

36 Claims, 24 Drawing Sheets

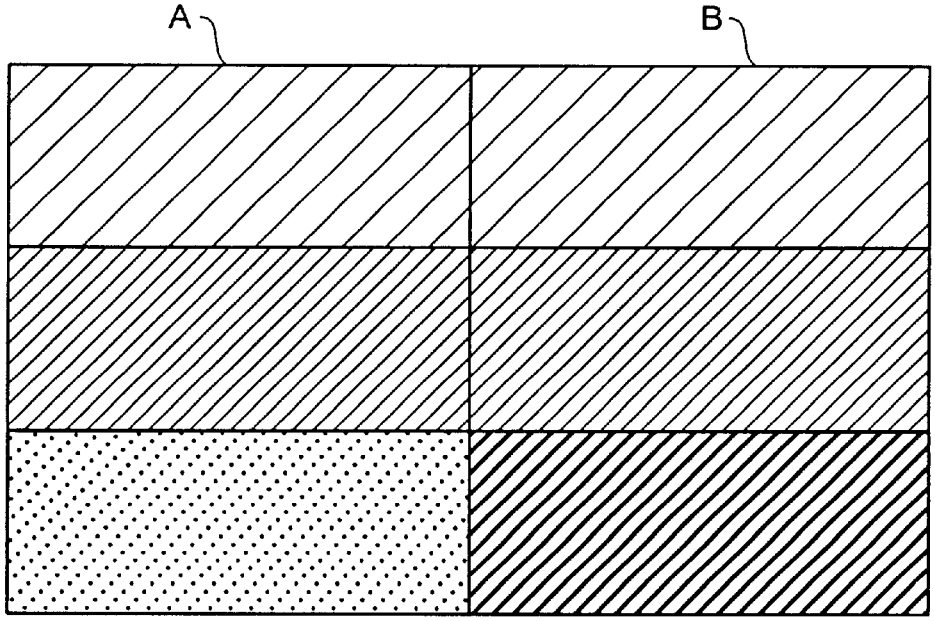
FIG. 1A
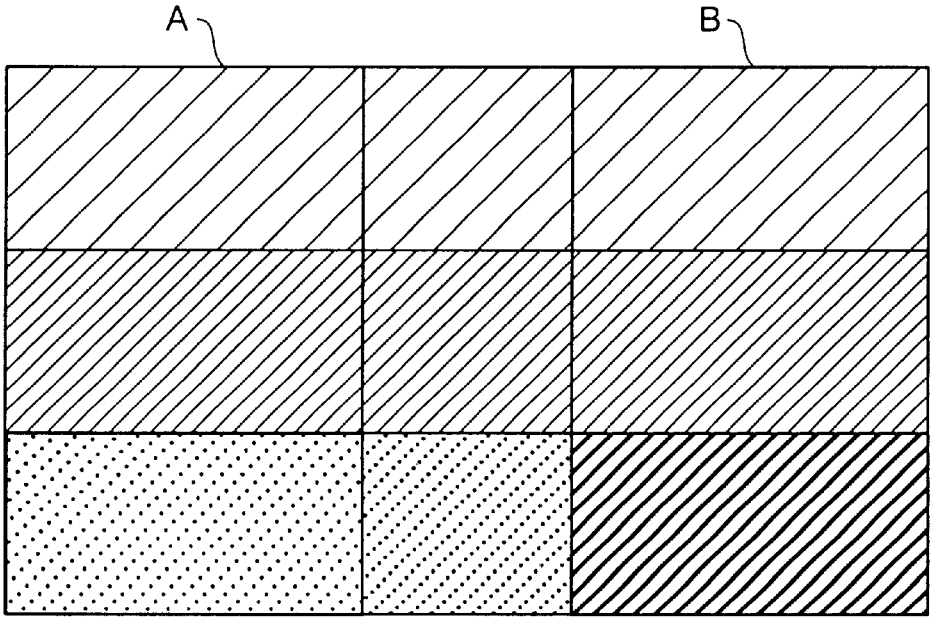
FIG. 1B
FIG. 1

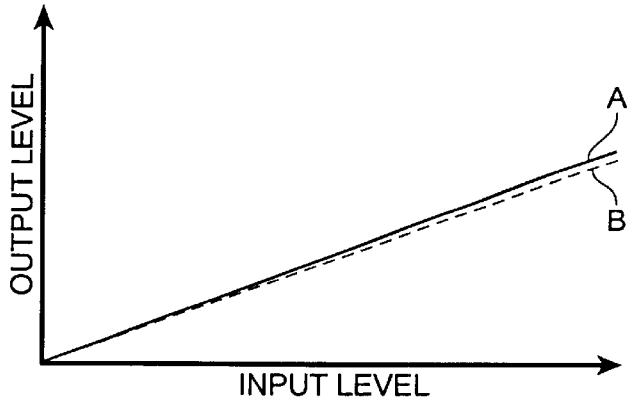
FIG. 5A
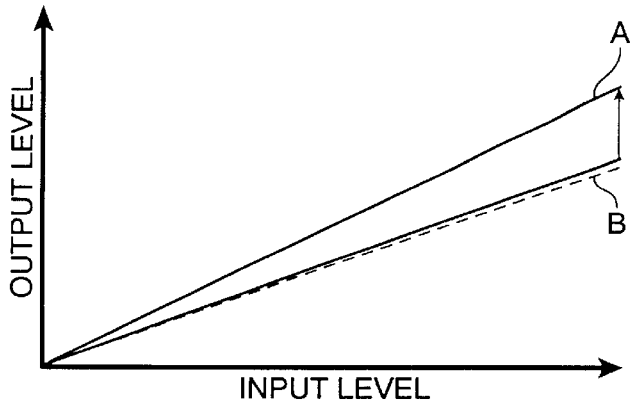
FIG. 5B
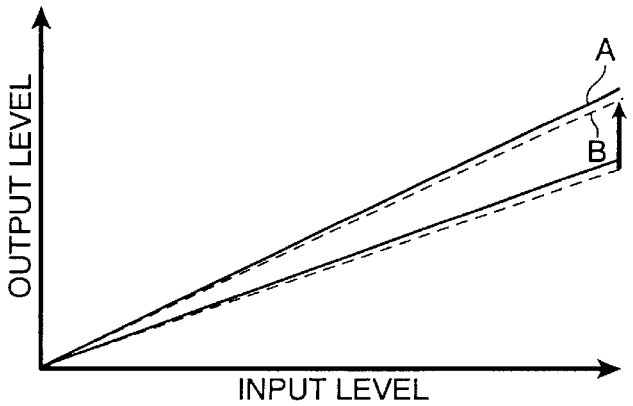
FIG. 5C
FIG. 5

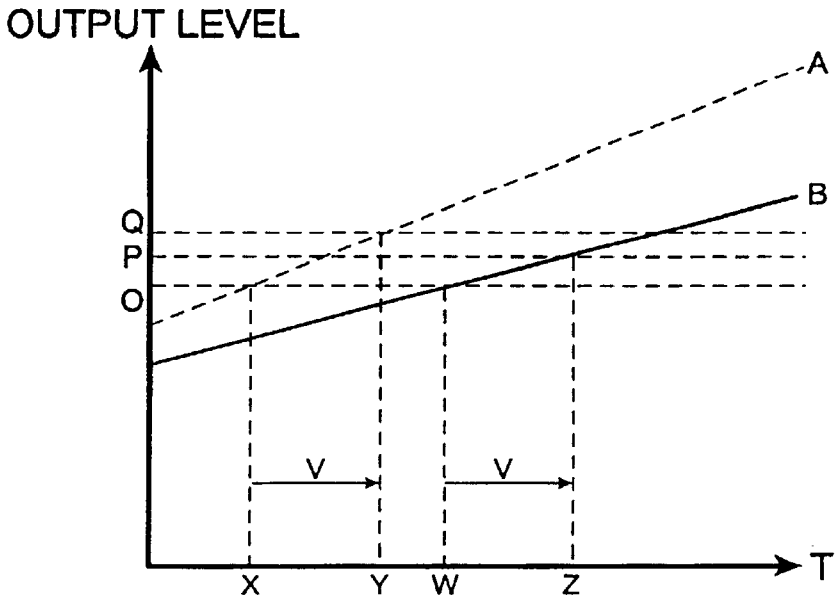
FIG. 6A
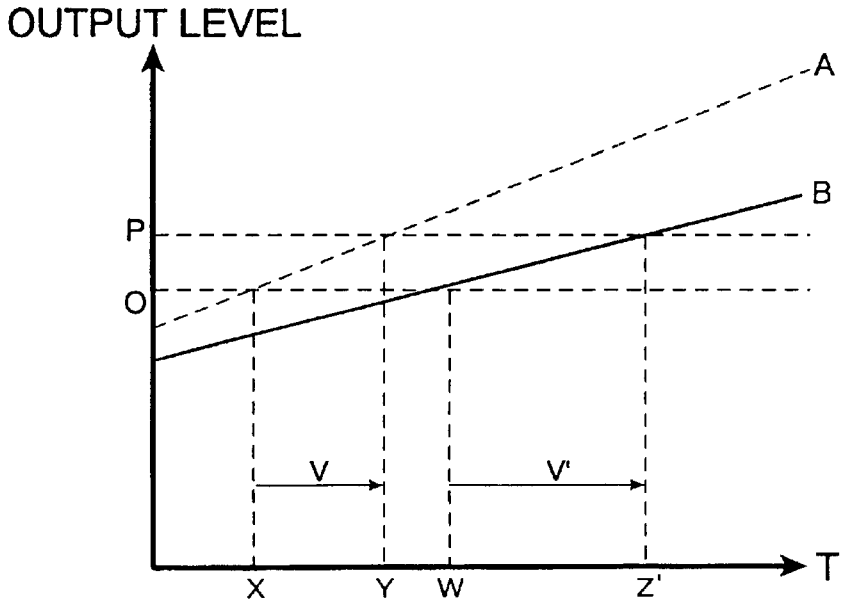
FIG. 6B
FIG. 6

| O.D. \ HEAD | TEMPERATURE | |
|---|---|---|
| | A | B |
| O | AO | BO |
| P | AP | BP |
| Q | AQ | BQ |
| R | AR | BR |
| • | • | • |
| Z | AZ | BZ |

| | TEMPERATURE | | |
|---|---|---|---|
| O.D. \ HEAD | A | B | C |
| O | AO | BO | CO |
| P | AP | BP | CP |
| Q | AQ | BQ | CQ |
| R | AR | BR | CR |
| • | • | • | • |
| Z | AZ | BZ | CZ |

FIG. 15

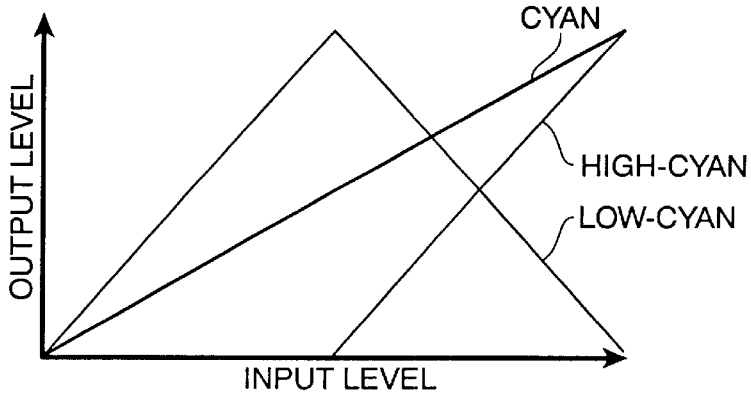
FIG. 16A
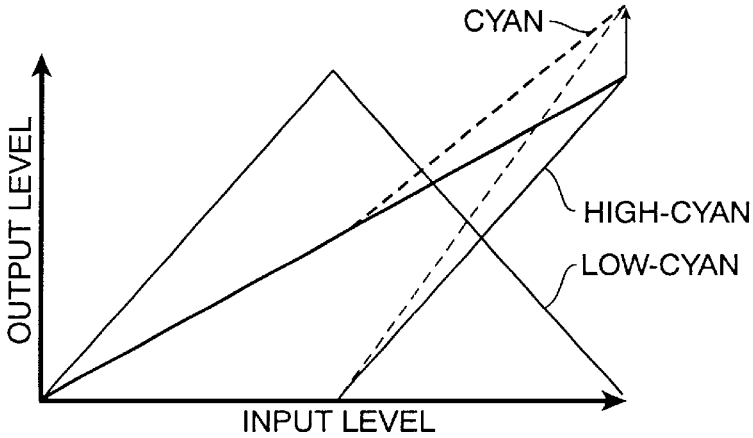
FIG. 16B
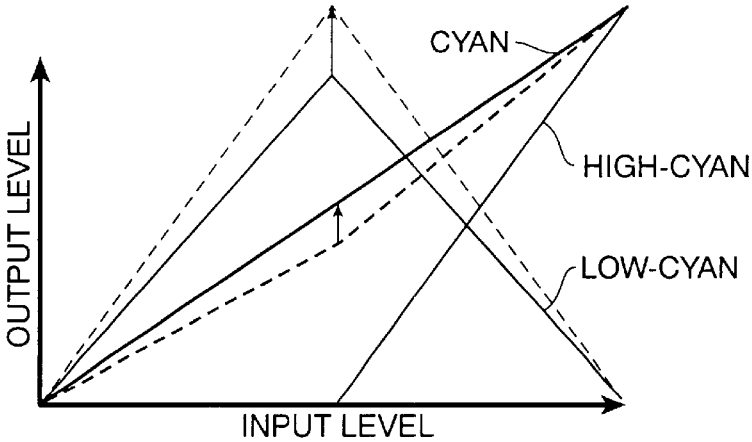
FIG. 16C
FIG. 16

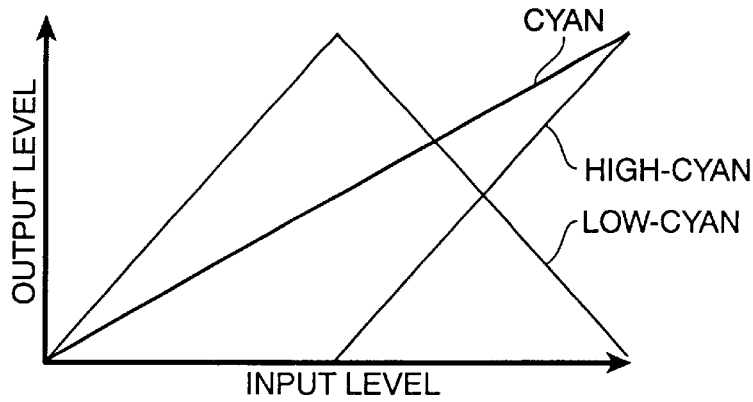
FIG. 17A
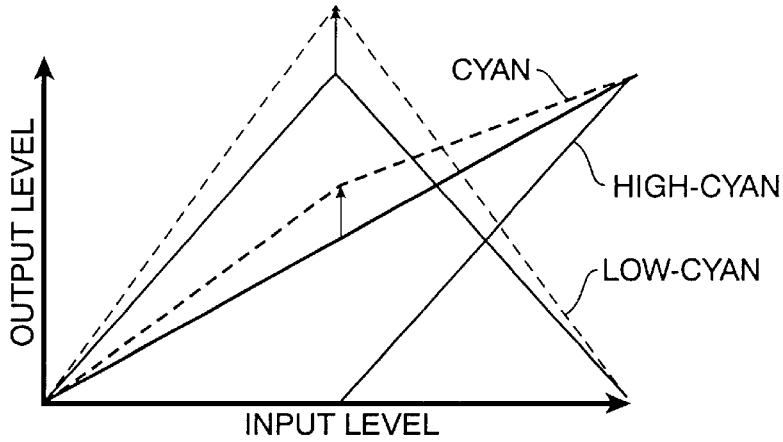
FIG. 17B
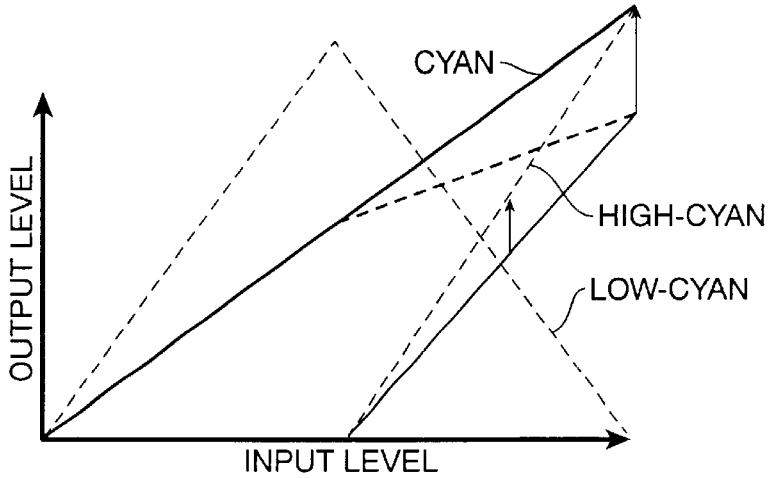
FIG. 17C
FIG. 17

| HEAD / O.D. | TEMPERATURE | | HEAD / O.D. |
|---|---|---|---|
| | A | B | |
| O | AO | BO | O/2 |
| P | AP | BP | P/2 |
| Q | AQ | BQ | Q/2 |
| R | AR | BR | R/2 |
| • | • | • | • |
| Z | AZ | BZ | Z/2 |

FIG. 18

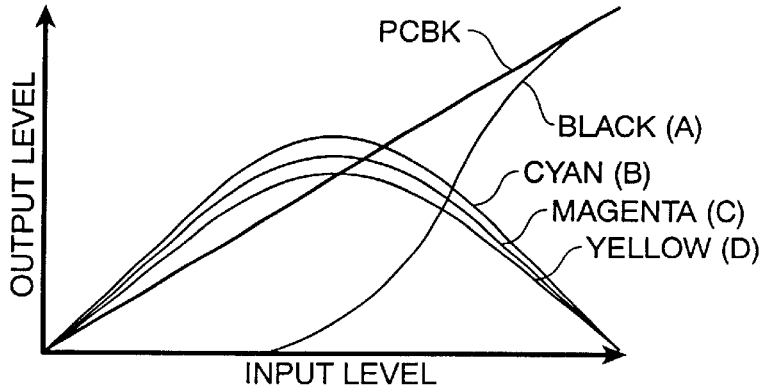
FIG. 19A
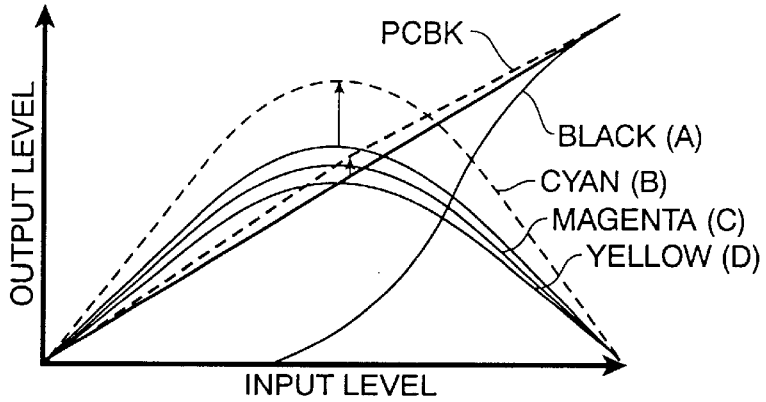
FIG. 19B
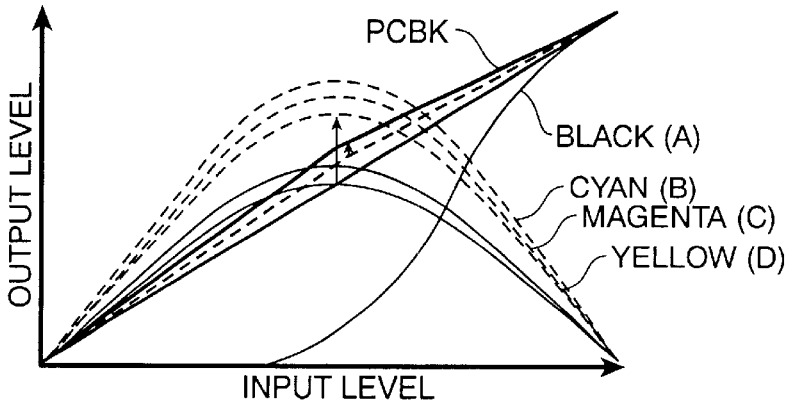
FIG. 19C
FIG. 19

| HEAD / K[Tx] 1/2 O.D. | C | M | Y | K |
|---|---|---|---|---|
| | TTc[K] | TTm[K] | TTy[K] | TTk[K] |
| O | CO | MO | YO | KO |
| P | CP | MP | YP | KP |
| Q | CQ | MQ | YQ | KQ |
| R | CR | MR | YR | KR |
| • | • | • | • | • |
| Z | CZ | MZ | YZ | KZ |

FIG. 21

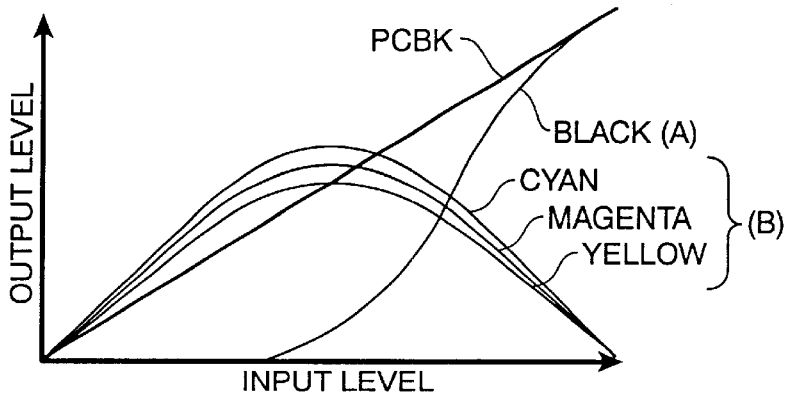
FIG. 23A
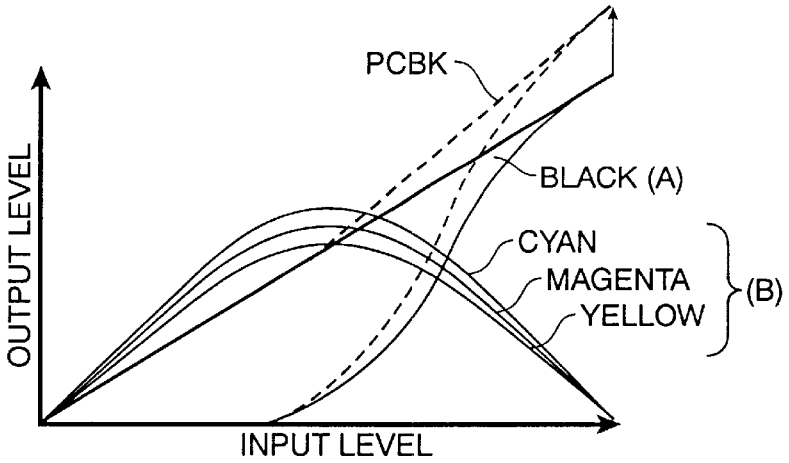
FIG. 23B
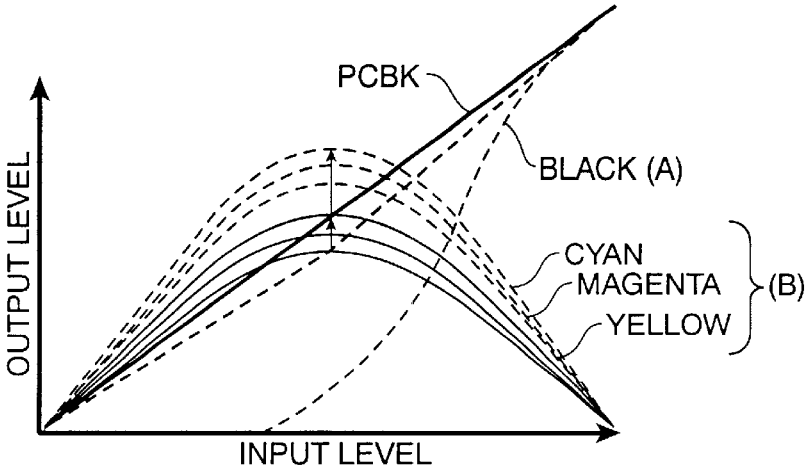
FIG. 23C
FIG. 23

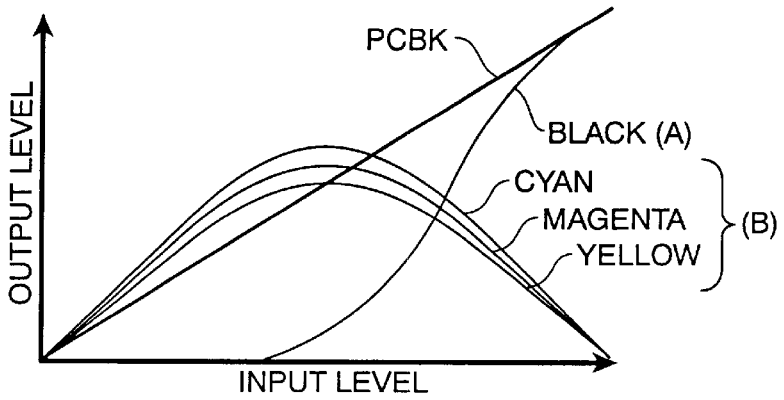
FIG. 24A
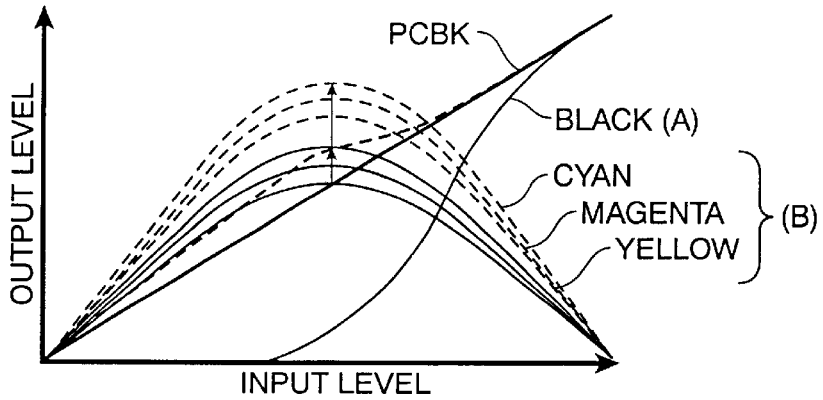
FIG. 24B
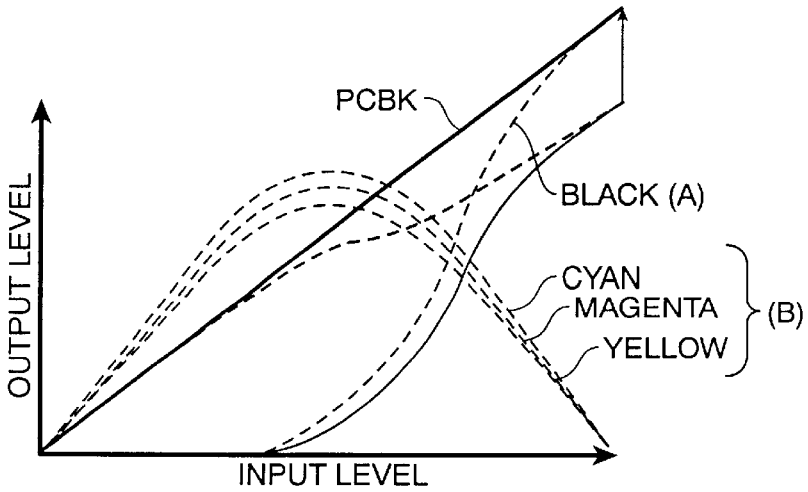
FIG. 24C
FIG. 24

PRINTING DEVICE HAVING AN OUTPUT LEVEL COMPENSATION FUNCTION

BACKGROUND OF THE INVENTION

1. Field of the Invention

The present invention relates to shuttle-type image printing devices which print characters and images on a print medium by scanning multiple printheads across the print medium. In particular, the invention provides for improved output from shuttle-type printing devices in which multiple printheads are disposed at a fixed distance from each other and wherein each printhead scans and prints over a divided section of a print medium.

2. Description of the Related Art

Some conventional printing devices use full-line printheads, which are capable of simultaneously printing an entire line of data upon a print medium. Unfortunately, such printheads are quite expensive.

In contrast, serial printing devices operate by scanning a printhead across a print medium. The printhead forms images upon the print medium as it is scanned across. These printheads are required to print only a small amount of data at any one time and are therefore generally less expensive than full-line printheads.

However, one drawback of such serial printing is that high speed printing is difficult to achieve.

Japanese Laid-Open Patent Application No. 50-81437 and U.S. Pat. No. 4,272,771, disclose examples of methods to increase the print speed of serial image printing instruments. According to these documents, the left and right halves of each printed line are printed simultaneously. To achieve this feature, left and right printhead assemblies are provided, both of which are supported by a common carriage mechanism. Accordingly, print speed is approximately doubled over that of serial printing devices. Furthermore, these references suggest that further increases in print speed can be achieved by using more than two printhead assemblies or by printing in both the left and right scanning directions.

Color, high quality and high speed printing have been performed using multiple printheads working in conjunction. While utilizing these configurations, certain relative output levels must be maintained among the multiple printheads. If these relative output levels are not maintained, the color, or gradient, becomes out of balance, or the print density becomes uneven. In general, print quality may be degraded due to incorrect relative output levels.

For example, in a configuration where multiple printheads print in respective divided sections of a print medium, any characteristic differences among the printheads, the ink or the ink ribbons causes mismatches in print density between the divided sections.

FIG. 1A and FIG. 1B illustrate this phenomenon. In FIG. 1A, two printheads, printhead 4A and printhead 4B, have printed within the section designated A and the section designated B, respectively. As shown, printhead 4B produces a more dense output than that of printhead 4A. The Figure illustrates the printing results for three printing duties, 25%, 50% and 100%. The Figure shows that, for each printing duty, the difference in print densities between section A and section B is very noticeable at the border between the two sections.

FIG. 1B illustrates similar printing results utilizing the same printheads while redefining section A and section B so as to add a small overlap between the two sections. Each printhead prints approximately half of the total print data in the overlapped printing area. Hence, the printing density of the overlapped area is greater than that of section A. However, the density is lower than that of section B. Therefore, in the case of FIG. 1B, the density differences are less noticeable than that shown in the above FIG. 1A, but are still obvious at both borders of the overlapped printing area. Accordingly, it is necessary to compensate for differences in print density caused by differences in output characteristics of utilized printheads.

The above problem may be addressed by selecting printheads having the same output characteristics. This approach is not realistic for printing devices in which printheads (or printhead cartridges) can be replaced. Hence, what is needed is a method to compensate for fluctuating output levels of each printhead and to maintain a certain output level balance among multiple printheads.

One important consideration in devising such a method is that, in operation, various printing signals (image data), each having various printing duties, are sent to the multiple printheads of a shuttle-type printing device. The varying duties give rise to varying driving duties of the printheads. The temperature of each printhead will vary accordingly. Furthermore, output characteristics of printing heads are dependent upon their respective temperatures. Hence, when the temperatures of printheads vary during operation, a particular output level relationship of the printheads becomes particularly difficult to maintain.

SUMMARY OF THE INVENTION

One purpose of this invention is to provide a printer driver, an image printing device and a method which prevent a color balance from varying even when the temperatures of multiple printheads vary.

Yet another purpose of this invention is to provide a printer driver, an image printing device and a method which prevent a gray balance from varying even when the temperatures of multiple printheads vary.

A further purpose of this invention is to provide a printer driver, an image printing device and a method which prevent a gradient balance from varying even when the temperatures of multiple printheads vary.

In order to achieve the above purposes, this invention is characterized by a system to obtain a temperature of each of multiple printheads, to determine, based on the obtained temperature of one of the printheads, a target temperature corresponding to each other of the multiple printheads in order to maintain a predetermined relationship between an output level of the one printhead and an output level of each other of the multiple printheads to adjust the temperature of each other of the multiple printheads to the corresponding determined target temperature and to print an image using the multiple printheads.

In one aspect, the invention is further characterized by a system to determine the target temperature corresponding to each other of the multiple printheads so that an output level of an image printed by the one print head is equal to an output level of an image printed by each other of the multiple printheads.

In another aspect, the invention is characterized by a system wherein each of the multiple printheads uses a different color ink to print an image and the target temperature corresponding to each other of the multiple printheads is determined in order to maintain a predetermined color balance between an image printed by the one printhead and an image printed by each other of the multiple printheads.

In a third aspect, the present invention is further characterized by a system wherein each of the multiple printheads uses a different color ink to print an image, one of the inks being black ink, and wherein the target temperature corresponding to each other of the multiple printheads is determined in order to maintain a predetermined gray balance between an image printed by the one printhead and an image printed by each other of the multiple printheads.

In yet another aspect, the present invention is further characterized by a system wherein each of the multiple printheads uses ink of a density different than a density of ink used by any other of the multiple printheads, and wherein the target temperature corresponding to each other of the multiple printheads is determined in order to maintain a particular gradient balance between an image printed by the one printhead and an image printed by each of the other multiple printheads.

This brief summary has been provided so that the nature of the invention may be understood quickly. A more complete understanding of the invention can be obtained by reference to the following detailed description of the preferred embodiments thereof in connection with the attached drawings.

BRIEF DESCRIPTION OF THE DRAWINGS

FIG. 1, comprising FIG. 1A and FIG. 1B, illustrates uneven printing output in a case where multiple printheads are used in a conventional shuttle-type printing device.

FIG. 5, comprising FIG. 5A, FIG. 5B, and FIG. 5C, illustrates various output levels of two printheads before and after application of a compensation method according to the present invention.

FIG. 6, comprising FIG. 6A and FIG. 6B, are diagrams of temperature-output level relationships of multiple printheads for illustrating a compensation method according to the present invention.

FIG. 15 shows a target temperature table according to the present invention for use with a printing process using three printheads.

FIG. 16, comprising FIG. 16A, FIG. 16B, and FIG. 16C, illustrates output level variations among printheads having ink of different viscosities.

FIG. 17, comprising FIG. 17A, FIG. 17B, and FIG. 17C, illustrates output level variations among printheads having ink of different viscosities.

FIG. 18 is a target temperature table for use with printheads having ink of different viscosities.

FIG. 19, comprising FIG. 19A, FIG. 19B, and FIG. 19C, illustrates color balance deviation among color printheads and a method for compensating for such deviation according to the present invention.

FIG. 21 shows a target temperature table for color printheads according to the present invention.

FIG. 23, comprising FIG. 23A, FIG. 23B, FIG. 23C, illustrates color and gray balance deviation among color printheads and a method for compensating for such deviation according to the present invention.

FIG. 24, comprising FIG. 24A, FIG. 24B, and FIG. 24C, illustrates color and gray balance deviation among color printheads and a method for compensating for such deviation according to the present invention.

DETAILED DESCRIPTION OF THE PREFERRED EMBODIMENTS

The foregoing embodiments of the present invention are described in view of the above-mentioned Figures.

The First Preferred Embodiment

Figure 2:
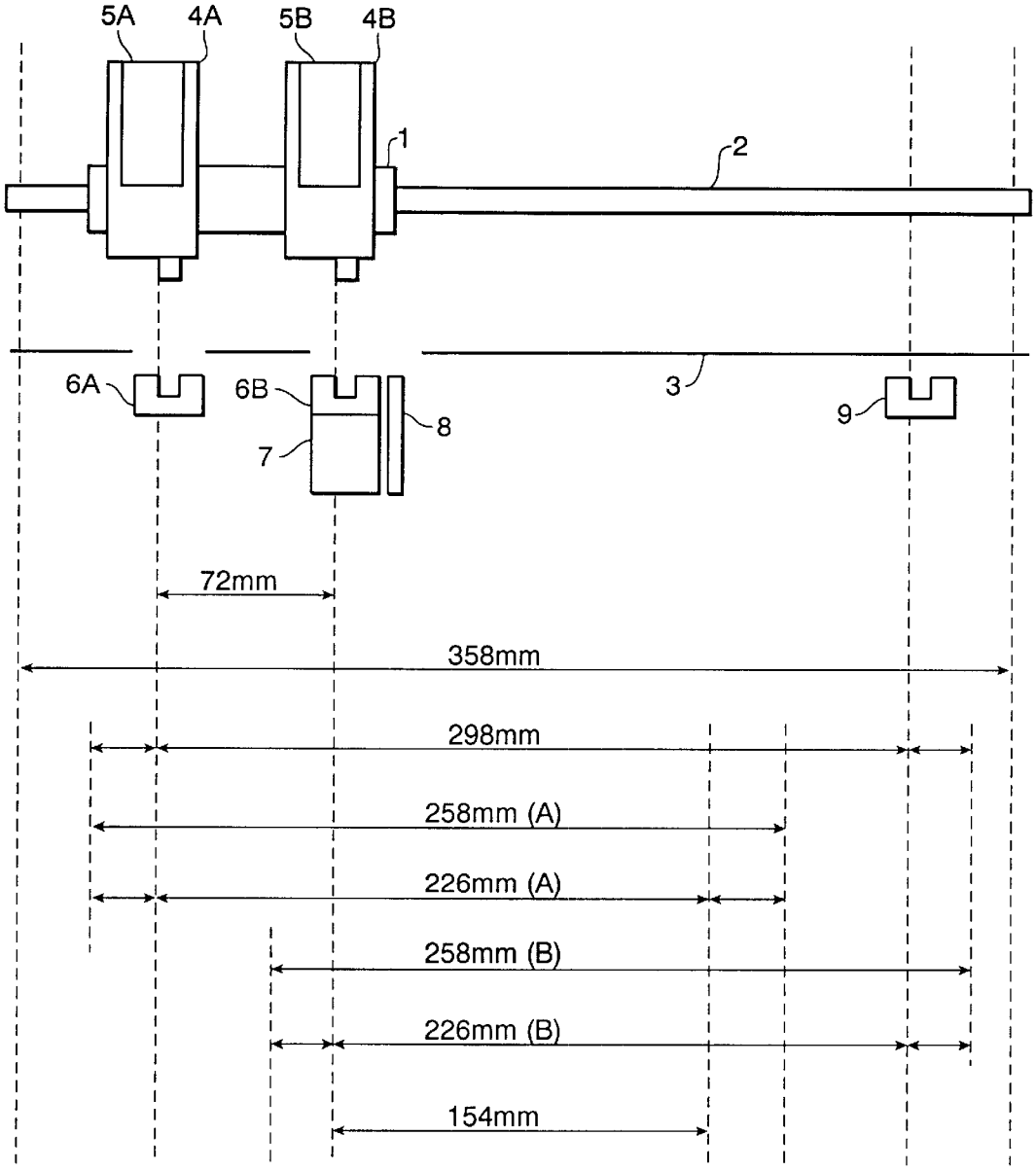
FIG. 2 illustrates regions of divided printing and overlapped printing in a case where two printheads are used in a printing device.

FIG. 2 shows printheads 4A and 4B mounted on carriage 1 at a separation of 72 mm. Printheads 4A and 4B support, respectively, ink tanks 5A and 5B. Ink stored in the tanks is provided to the printheads during printing. This design allows for independent installation and removal of each tank and each printhead on the carriage 1. Alternatively, a printhead and a tank can be formed as one unit, and the combined unit can be installed on and removed from carriage 1.

Carriage 1 is supported on guide rail 2 and can be moved freely by virtue of a drive mechanism, such as a drive belt. As a result, carriage 1 can be located anywhere within the scannable space, denoted by "358 mm" in FIG. 2. In addition, the ink jet nozzles of each of printhead 4A and 4B can be located anywhere within each of scanning areas "258 mm(A)" or "258 mm(B)" respectively. Excluding ramp up and ramp down areas, at which carriage 1 accelerates and decelerates, printhead 4A scans in its divided printing area "226 mm(A)", and printhead 4B scans in its divided printing area "226 mm(B)".

Caps 6A and 6B are used for the ink jet nozzles of printheads 4A and 4B, respectively, under a platen 3 within the scannable space of the carriage 1. The carriage 1 rests over the platen at a home position, whereat each ink jet nozzle is capped with either cap 6A or 6B. Pump 7 is connected to cap 6B and removes ink through cap 6B. Each of heads 4A and 4B travels to a position facing cap 6B sometime during operation therefore ink can be removed from either printhead using pump 7.

Wiper 8 is provided adjacent to cap 6B. Wiper 8 moves outward at a certain time into the path of one of the printheads and wipes ink jet nozzles of the printhead as it comes in contact with wiper 8. In addition, dummy ejection receptor 9 is provided on the opposite end of the scannable space of printhead 4A from "226 mm(B)" where cap 6A is located. Printhead 4B can travel to this position sometime during operation and perform a dummy ejection. Similarly, printhead 4A can perform a dummy ejection after it travels to a position facing cap 6A.

The foregoing arrangement maximizes the printable area within the scannable space.

In the above-described embodiment of a printing device, the printhead separation distance (72 mm), is preferably set to approximately one-quarter of the maximum printable area (298 mm). The printable area is maximized by dividing it into two scanning areas for each printhead. The width of the overlapped scanning area is 154 mm. These sizes are defined as follows. The width of A3 paper (297 mm×420 mm) is the width of the maximum printable area. The width of the overlapped scanning area corresponds to the width of A5 size paper (148 mm×210 mm). Therefore, the width of the maximum printable area is defined at approximately twice that of the overlapped scanning area.

In this preferred embodiment, each of printheads 4A and 4B print on assigned printing areas, respectively, in a case where the instrument prints on A3 size paper. In this case, both printheads preferably eject the same type of ink. On the other hand, when the printing instrument prints on A5 size paper, which is the width of the overlapped printing area, one printhead may be replaced by a type of printhead which ejects ink with a lighter color so that ink with darker and lighter colors may be printed at areas of the page which can be accessed by both printhead 4A and printhead 4B.

Accordingly, the printing device of the embodiment of FIG. 2 can print faster over A3 size print media than a printing device with one printhead because the work of printing over the maximum printable area is divided between two printheads. In addition, the size of the printing device of FIG. 2 is smaller than other devices having the same maximum printable area.

The design of this preferred embodiment benefits single color printing, such as black and white. However, when using multiple color inks for color printing, the benefits are more pronounced.

Regarding color printing, there are several types of printing devices which utilize a print medium which itself generates color. Examples of such devices include a device in which heating elements on a thermal printhead heat special thermal paper, thereby generating color, and a device in which optical effects create color upon photosensitive paper.

On the other hand, various methods are used in which printheads transfer color ink onto print media. For example an impact printing method, ink ribbons contain liquid color ink which is transferred to a print medium when printing wires press the ribbons against the print medium. In thermal melt and sublimation transfer printing methods, heating elements on a thermal printhead heat solid ink on ink ribbon printheads and transfer the ink to a print medium. In an ink jet method, liquid ink is ejected onto a print medium.

Of the above examples, devices in which color ink is transferred onto print media are used more widely due to their use of ordinary paper. Among these methods, ink jet printing has the advantages of low noise, lower operation cost, ease of miniaturization, ability to use ordinary paper, and ease of color printing. Hence, this method is widely used in various printing devices, such as printers and photocopiers.

Ink jet printing devices include those in which the use of multiple printheads allows them to realize color printing, gradient printing or high resolution printing. For example, color printing can be performed using four printheads, each having a different color ink, yellow (Y), magenta (M), cyan (C) and black (K), or using three printheads containing Y, M and C. Gradient printing can be performed using a higher output level printhead which prints at a high density and a lower output level printhead which prints at a low density. High resolution printing can be performed using multiple printheads for each color, which are installed so as to provide interlaced printing.

In this color printing embodiment, four color inks, black (Bk), cyan (C), magenta (M) and yellow (Y) are used. Four individually replaceable tanks, one for each color ink, Bk, C, M or Y, are installed on the central portion of carriage 1 of FIG. 2. Each printhead is equipped with a group of ink jet nozzles, each of which ejects, respectively, Bk, C, M or Y ink. The four ink tanks supply color ink to both printheads. Even though this embodiment is designed to supply ink from common ink tanks to each printhead, applications of this invention are not limited to this design. For example, each printhead can be equipped with an exclusive ink tank and each tank can thereby form a single unit with its respective printhead. Also, such tanks can be made removable from the printheads.

Figure 3:
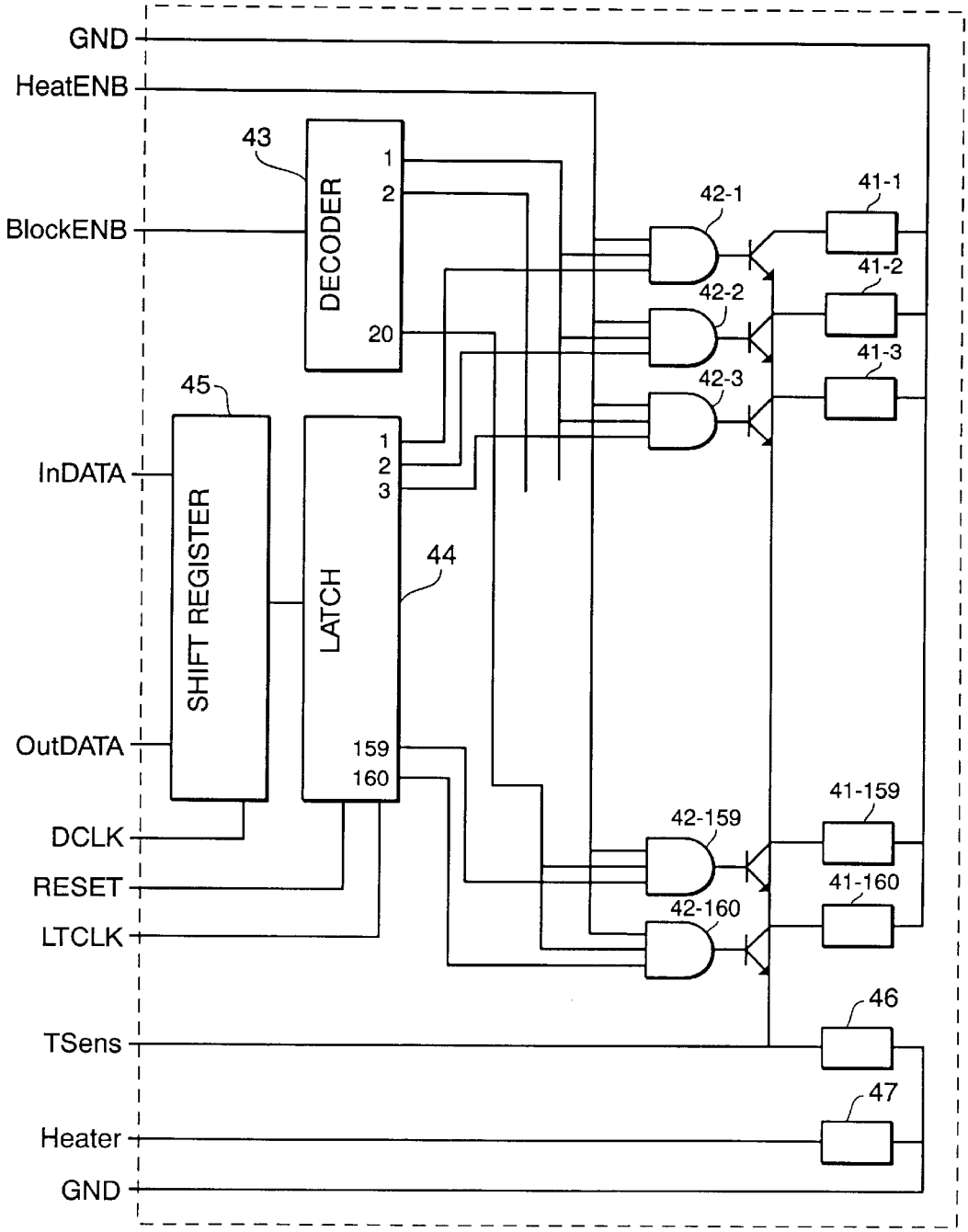
FIG. 3 is a block diagram of a driving circuit for use with the printheads used in the printing device of FIG. 2.

FIG. 3 is a block diagram for a heater driver of a printhead similar to printheads 4A and 4B. Heaters 41-1, 41-2, . . . , 41-160 each correspond to a respective ink jet nozzle used for a particular color ink. Accordingly, each nozzle may be individually heated. Here, 16 heaters are used for Y (yellow) nozzles, 24 for both M (magenta) and C (cyan), 64 for K (black), and a total (32 for four sets) of 8 nozzles disposed between each of these colors. When each of heaters 41 are turned on at the same time, a large current flows and the load on the power supply increases. In addition, because voltage drops across the circuit impedance, the energy supplied to each of the heaters decreases. This may jeopardize normal printing functions.

Thus, a concern for the ill-effect on image quality also arises. Therefore, in this preferred embodiment, printheads are installed at a small angle, and the well-known method of time-sharing driving is used for heater control. Under this time-sharing driving method, heaters are grouped into blocks, each of which contains the same number of heaters. In addition, the image data and print timing are adjusted block by block for ink ejection.

Various ways of realizing the time-sharing driving method have been proposed and implemented. Any of these methods can be used. In this preferred embodiment, color ink jet nozzles are divided into 20 blocks. Each block contains 8 ink jet nozzles. These ink jet nozzles include 8 ink jet nozzles for mixed colors. Each block ejects ink sequentially, one after another, with a certain constant interval.

The printheads are installed at an angle in order to compensate for the scanning speed of the printheads and the ejection time differences among the ink jet nozzle blocks. The angled installation of the printheads prevents the ejection time differences among the ink jet nozzle blocks from causing a straight line to be slanted.

During printhead operation, ink is provided via shared liquid chambers located behind the ink paths leading to the nozzles. One liquid chamber is provided for each ink color.

Ink is supplied from the shared liquid chambers through ink supply pipes to ink tanks 5A and 5B. Heater 41 and electrical wires are installed on the ink path leading to each ink jet nozzle. Heater 41 is a thermo-electrical converter which generates thermal energy for ink ejection. The electrical wires supply power to the heater. The heater and electrical wires are formed on a substrate such as a silicon wafer using thin film technology. A protective film is formed on heater 41 so that the heater does not come into direct contact with ink. Furthermore, the ink jet nozzle, ink path and shared liquid chamber are formed by stacking walls made of material such as resin and glass.

Once heater 41 heats the ink inside a nozzle to boiling, bubbles are formed within the ink. The bubble formation increases pressure within the ink jet nozzles, and the increased pressure causes ink droplets to be ejected toward a print medium. An ejected ink droplet for each color weighs approximately 40 ng. This printing method is generally called bubble jet printing.

AND gates 42-1 to 42-160 logically multiply a selection signal from a decoder 43, driving data from latch circuit 44 and a heat enable signal (Heat ENB). The selection signal is used in the time sharing process and the heat enable signal dictates the driving time. A shift register 45 converts serial image data input signals into parallel signals and outputs the resulting driving data to the latch circuit 44. The resulting output signal is transmitted to respective heater 41.

Temperature sensors 46 are provided on printheads 4A and 4B in this preferred embodiment. The sensors monitor the respective temperatures of printheads 4A and 4B. Generally, optimum driving conditions for the printheads are determined depending on the temperatures of printheads 4A and 4B. A protective mechanism is operated which is also based on the temperature information. Each of these provisions improve the stability of the printing characteristics. Furthermore, temperature control heaters 47 are provided on printheads 4A and 4B in order to maintain printheads 4A and 4B at a particular temperature.

Figure 4A:
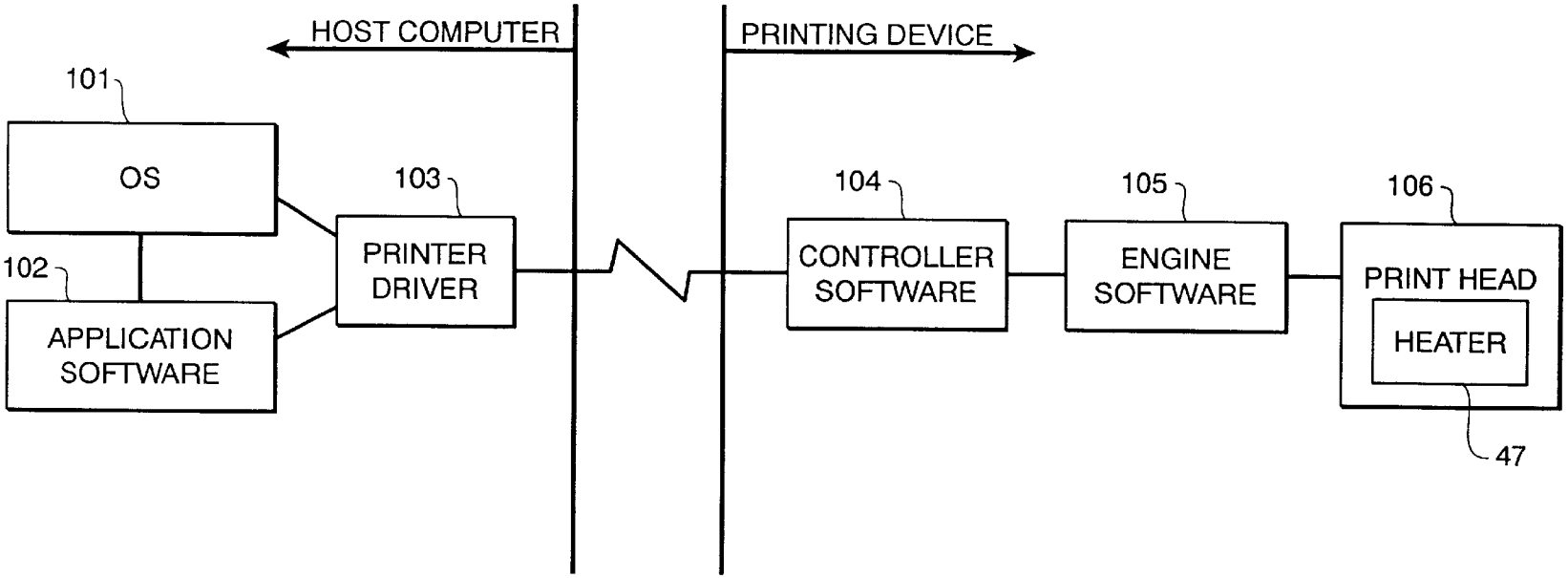
FIG. 4A shows a system configuration which illustrates the interface between a printing device and a host computer.

FIG. 4A shows a system which comprises a printing device and a host computer which functions as a hosting instrument. In the host computer, various data processing is performed by OS (Operating System) 101 in conjunction with application software 102. In operation, image data is generated by application software 102 and printer driver 103 outputs the image data to the printing device.

The image data is sent to printer driver 103 as multiple-level RGB data. After half-tone processing, the data is usually converted into binary CMYK data. The host computer then outputs the converted image data through a host computer/printing device interface or a file storage device interface. In the instance shown in FIG. 4A, the image data is output via a printing device interface.

The printing device receives the image data under the control of controller software 104, checks items such as printer mode and compatibility with printheads 106, and transfers the image data to engine software 105. Engine software 105 interprets the received image data as having the print mode and the data structure as instructed by the controller software 104 and generates pulses for the ink jet nozzles based on the image data. The pulses are sent to printheads 106. Printheads 106 use the pulses to eject color ink which corresponds to the pulses and to thereby print a color image on a print medium.

Figure 4B:
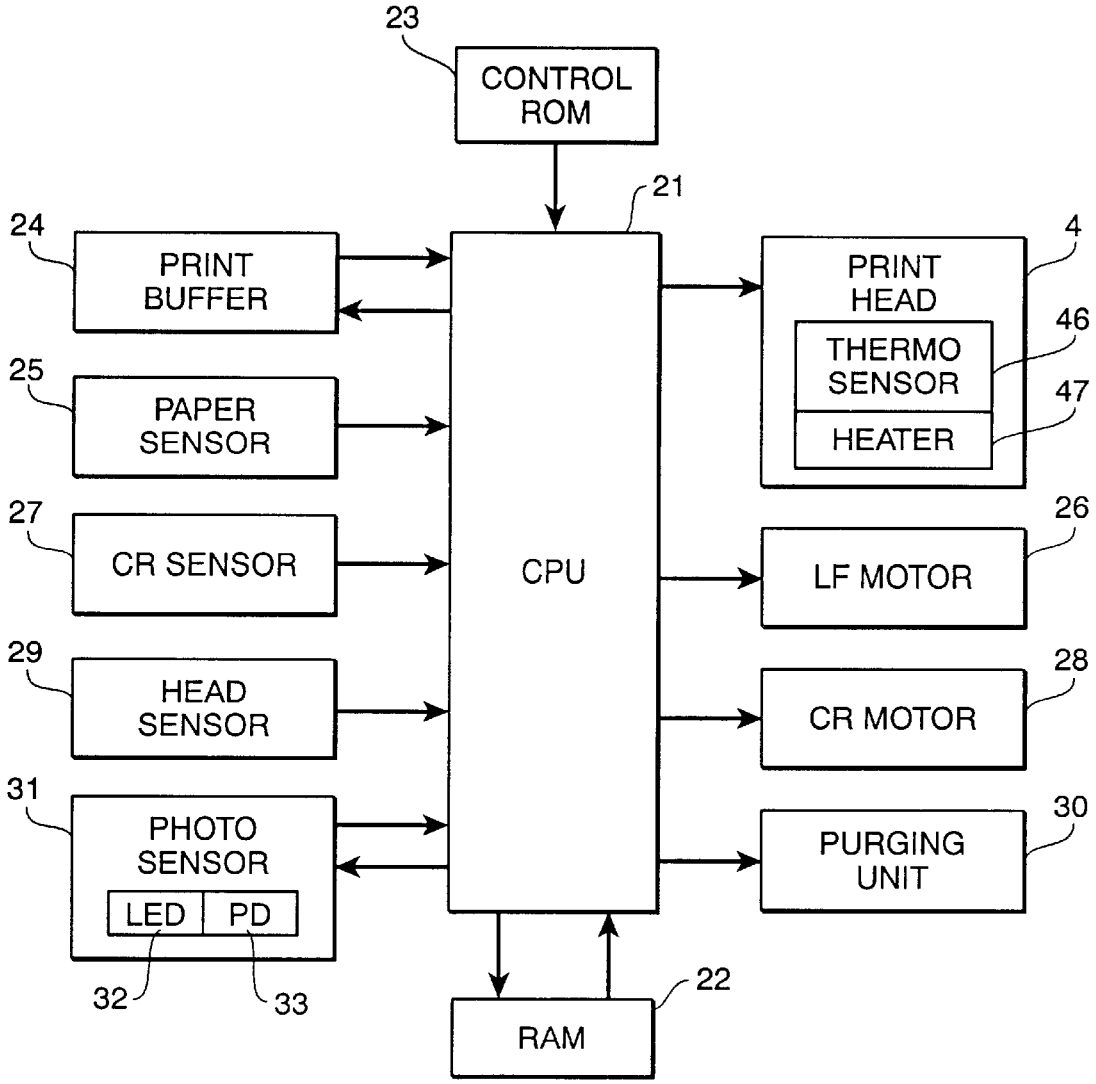
FIG. 4B is a block diagram of a controller for a printing device in accordance with the present invention.

FIG. 4B shows a block diagram of the printing device of FIG. 4A. Image data to be printed is transmitted into a receiving buffer in the printing device. In addition, data to acknowledge the correct receipt of image data by the printing device and data to show the operational status of the printing device are sent from the printing device to the host computer. The data in the receiving buffer is controlled under the management of CPU 21, stored temporarily in print buffer 24, and given to printheads 4A and 4B as print data.

Based on the information from paper sensor 25, CPU 21 sends commands to a paper forwarding mechanism. The paper forwarding mechanism, such as line feed motor 26, controls mechanical drivers such as paper forwarding rollers or line feed rollers based on commands from CPU 21. CPU 21 also sends commands to carriage-return driving mechanism 28 based on information from carriage return sensor 27. Carriage return mechanism 28 controls a carriage-driving power supply and thereby controls the movements of carriage 1. Purging unit 30 protects heads 4A and 4B and optimizes the driving conditions, using commands from CPU 21. CPU 21 sends such commands based on information sent by printhead sensor 29. Printhead sensor 29 comprises many sensors, for example, sensors such as those used to determine whether or not ink is present.

Commands from CPU 21 to photosensor 31 activate LED 32. Light from LED 32 subsequently reflected by test patterns on a print medium is then detected by photodiode 33. Based on the reflected light and on temperature readings from temperature sensors 46, CPU 21 controls the temperature of printheads 4A and 4B by controlling temperature control heaters 47. This temperature control is described in greater detail below.

In this preferred embodiment, printheads 4A and 4B print over the divided left and right printing areas shown in FIG. 2. Accordingly, the print data sent to printhead 4A is usually different from that sent to 4B. This difference creates a temperature difference between printhead 4A and 4B. Unfortunately, this temperature difference creates a difference in the amount of ink ejected by each printhead. One drawback of this situation is illustrated in FIG. 1. FIG. 5 graphically describes the phenomena of FIG. 1 and also shows one technique which addresses the problems thereby resulting.

The output levels of printheads 4A and 4B, which are indicated, respectively, by the solid line and the broken line in FIG. 5A, are originally adjusted equal by a well-known compensation method such as the pulse signal compensation method or the printhead temperature compensation method. FIG. 5B shows the case in which the duty of the printing data for printhead 4A, and therefore the temperature of printhead 4A, is higher than that of printhead 4B. In such a case, the output level of printhead 4A increases, as shown by the thicker solid line. Accordingly, when printing is performed in the case shown in FIG. 5B, the contrast between printing density of the left and right printing sections is undesirable.

Hence, as illustrated in FIG. 5C, it is necessary to bring the output level of printhead 4B up to the level of thicker broken line, which represents the output level of printhead 4A. FIG. 6A and 6B illustrate a method for doing so.

FIG. 6A and 6B show a case where, if the temperature of printhead 4A is set at X and that of printhead 4B at W, the output levels of printheads 4A and 4B are equal at O. (O.D.=Optical Density). When the duty of the printing data of printhead 4A is higher than that of printhead 4B, the temperature of printhead 4A increases by V to Y. As shown in FIG. 6A, the output level of printhead 4A then increases from O to Q.

In order to keep the output levels of printheads 4A and 4B the same, the temperature of printhead 4B must be increased. However, a temperature equal to that experienced by printhead 4A will not suffice to equalize output levels. As illustrated in FIG. 6A, the output level of printhead 4B only reaches level P when the temperature of printhead 4B is increased by V to Z. Accordingly, as shown in FIG. 6A, the output level of printheads with different output level characteristics cannot be balanced simply by maintaining a relative temperature difference between the printheads.

FIG. 6B shows the results of a temperature adjustment method according to the preferred embodiment. In particular, based on the temperature of printhead 4A, the temperature of printhead 4B is set so that the output levels of each printhead are equal. More particularly, the temperature of printhead 4B is set to Z' so that the output level of printhead 4B becomes equal to Q, which is the output level of printhead 4A at temperature Y. Notably, as described with respect to FIG. 6A, the temperature of printhead 4B must be increased by V', rather than by V.

Figures 7, 8:
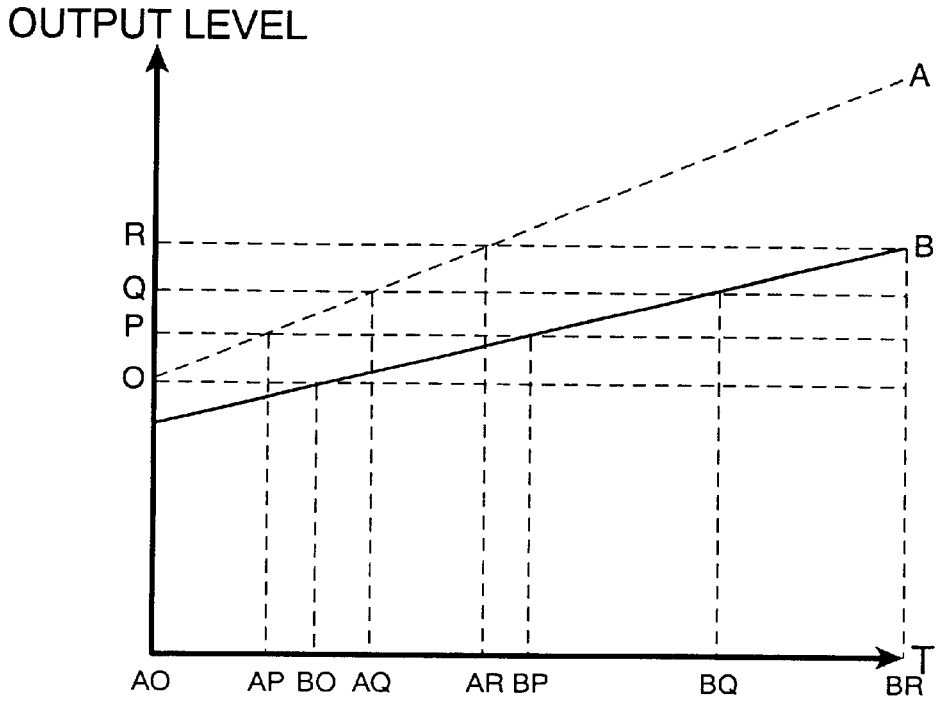
FIG. 7 is a temperature-output level diagram for illustrating temperature compensation of printheads A and B.
FIG. 8 shows a target temperature table for use in conjunction with a temperature compensation method according to the present invention.

In this preferred embodiment, for the purpose of performing the control described above, a target temperature table is constructed in Control RAM 22 or Control ROM 23. FIG. 8 shows a target temperature table of printheads 4A and 4B, which have the output level-temperature characteristics shown in FIG. 7. Specifically, for output levels of 0, P, Q, and R, the target temperatures of printhead 4A and 4B are AO, AP, AQ, AR, and BO, BP, BQ, and BR, respectively.

Figure 9:
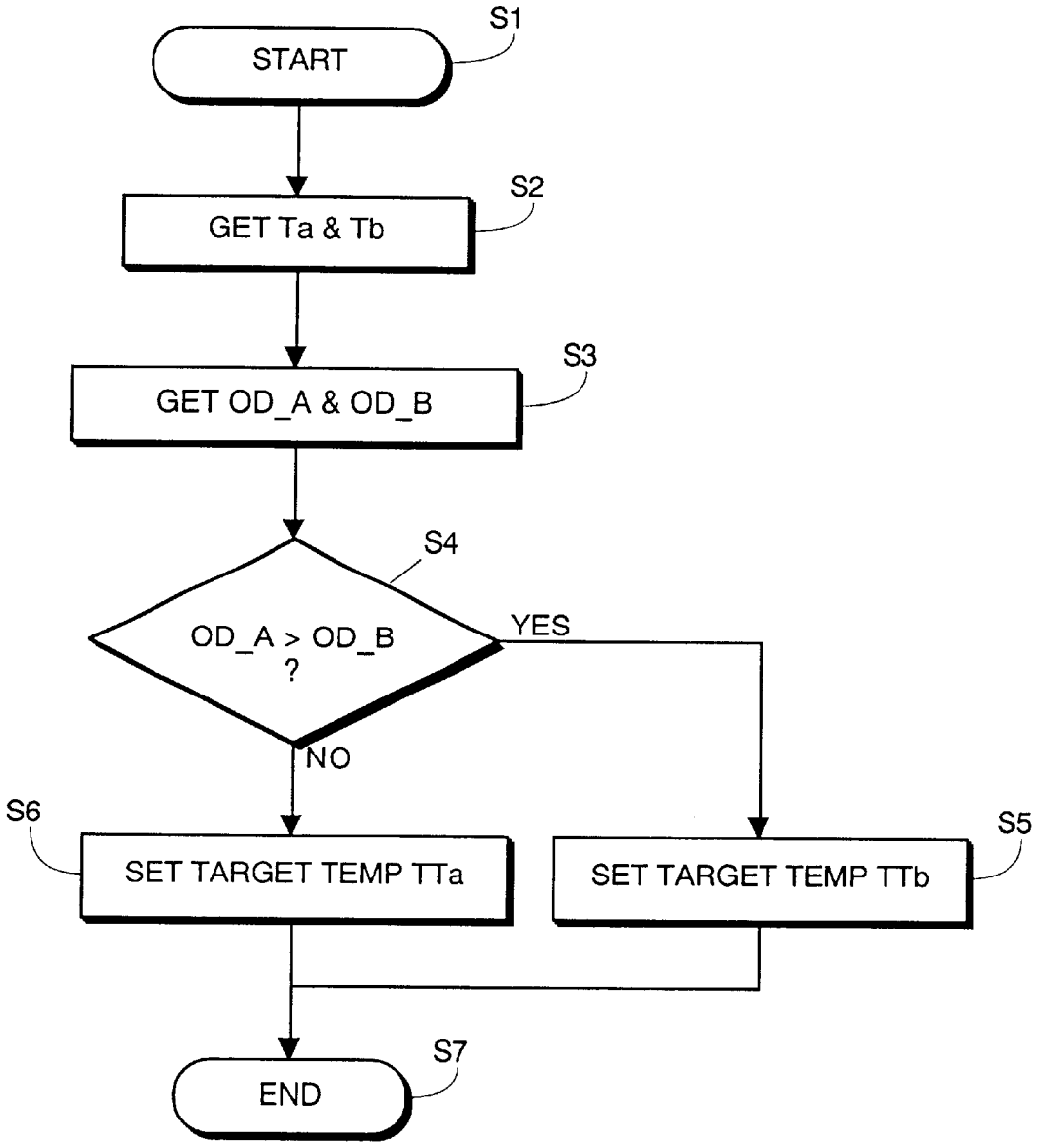
FIG. 9 is a flowchart describing a process for obtaining target temperatures according to the present invention.

A process for obtaining target temperatures according to this preferred embodiment is explained by the flowchart of FIG. 9.

At step S2 of the FIG. 9 flowchart, CPU 21 obtains temperatures Ta and Tb of printheads 4A and 4B, respectively, from sensors 46 which are provided on printheads 4A and 4B. At step S3, CPU 21, using photosensor 31, LED 32, and photodiode 33, obtains output levels OD_A and OD_B, which correspond to temperatures Ta and Tb, respectively. For example, when the temperature Ta of printhead 4A is AQ, the output level OD_A of printhead 4A is defined as AQ, and when the temperature Tb of printhead 4B is BP, the output level OD_B of printhead 4B is defined as BP.

At step S4, the output level OD_A of printhead 4A and the output level OD_B of printhead 4B are compared, and, in steps S5 and S6, the temperature of the printhead having a lower output level is set so that the output level corresponding to the set temperature increases to that of the printhead having a higher output level. For example, if the output level OD_A of printhead 4A is higher than OD_B of printhead 4B (Yes at step S4), the target temperature TTb of printhead 4B is set at that temperature which results in printhead 4B having an output level equal to OD_A. On the other hand, if the output level OD_A of printhead 4A is not greater than that OD_B of printhead 4B (No at step S4), CPU 21 determines, in step S6, the target temperature TTa of printhead 4A from the table in FIG. 8 which results in printhead 4A producing an output level equal to OD_B. Step S7 completes the target temperature determination.

In this preferred embodiment, heaters 47 are capable only of heating printheads and thereby causing output levels to increase. Hence, a printhead with a lower output level must be heated so that its output level matches that of the printhead with a higher output level. Of course, cooling devices, either alone or in conjunction with heaters 47, may also be utilized so as to adjust printhead temperatures and equalize output levels in accordance with the present invention.

In the flowchart of FIG. 9, output levels corresponding to certain temperatures are referenced in order to determine a target temperature of a printhead. However, in another embodiment, the printhead temperature is defined without reference to printhead output levels. This method is explained by the flowchart of FIG. 10.

Figure 10:
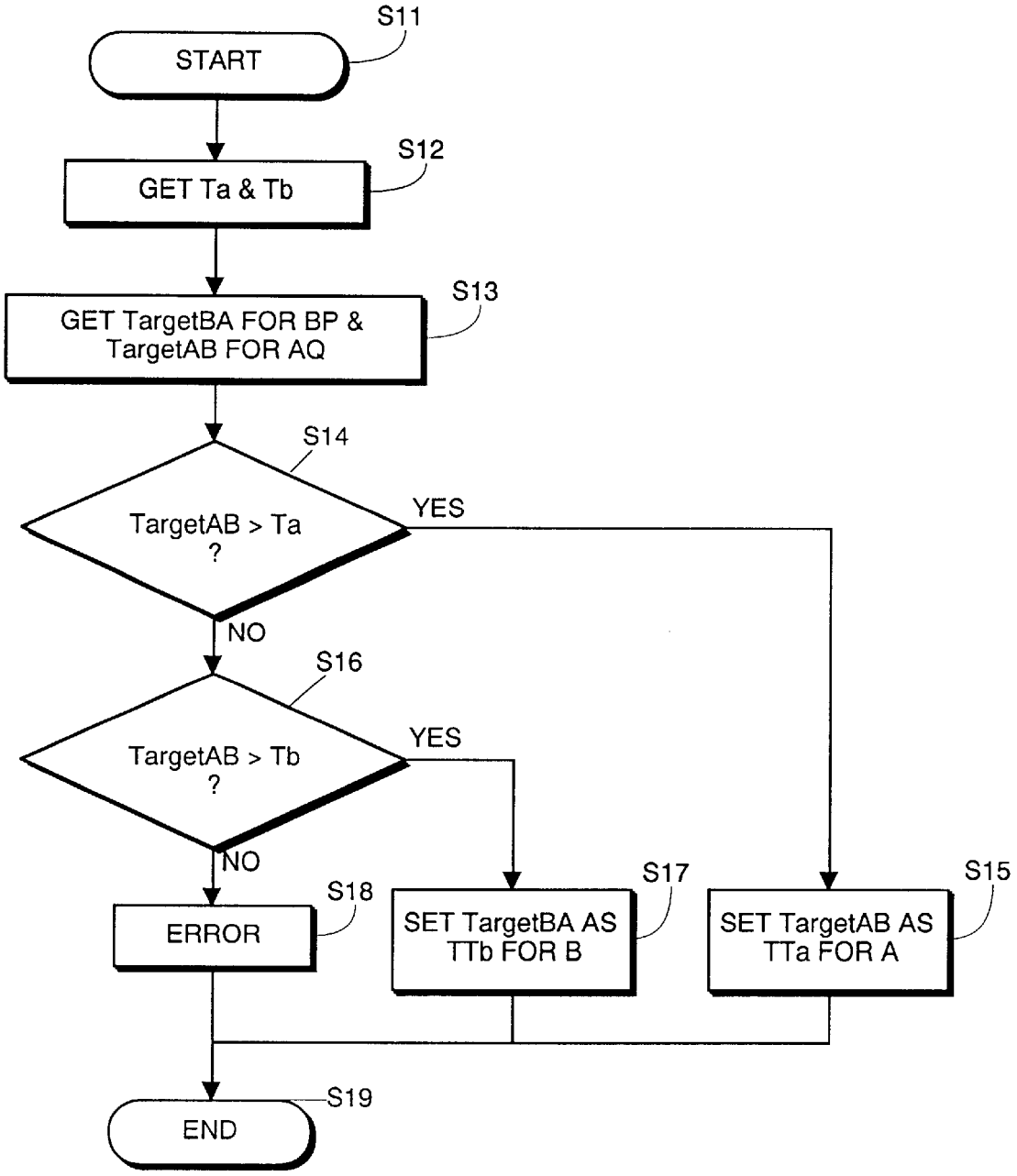
FIG. 10 is a flowchart describing a process for obtaining target temperatures according to the present invention.

At step S12 of FIG. 10, CPU 21 obtains the temperatures Ta and Tb of printheads 4A and 4B, respectively, from sensors 46 which are provided on printheads 4A and 4B. In step S13, tentative target temperatures BA and AB are obtained. The tentative target temperature BA brings the output level of printhead 4B to that of printhead 4A, and the tentative target temperature AB brings the output level of printhead 4A to that of printhead 4B.

For example, if the temperature of printhead 4A is AQ and that of printhead 4B is BP, the output level of printhead 4A is Q and that of printhead 4B is P. Therefore, in order to bring the output level of printhead 4B equal to that of printhead 4A, the temperature of printhead 4B must be adjusted to BQ, as defined by the table of FIG. 8. Hence, the tentative target temperature BA of printhead 4B is found to be BQ. Similarly, the tentative target temperature AB of printhead 4A is determined to be AP.

In step S14, the tentative target temperature AB is compared with the temperature Ta of printhead 4A. If the tentative target temperature AB is greater than the temperature Ta of printhead 4A, the tentative target temperature AB is defined, in step S15, as the target temperature TTa for printhead 4A. On the other hand, in step S16, the tentative target temperature BA is compared with temperature Tb of printhead 4B. If tentative target temperature BA is greater than temperature Tb of printhead 4B, the tentative target temperature BA is defined, in step S17, as the target temperature TTb for printhead 4B. As in the process of FIG. 9, heaters 47 can only heat printheads 4A and 4B. Hence, steps s14 to s17 ensure that a target temperature is set only for the printhead having a target temperature greater than its actual temperature. Of course, in another embodiment, cooling devices may also be used to adjust the temperature of a printhead to a tentative target temperature lower than its actual temperature.

If steps S14 and S16 both result in negative responses, the temperature sensor readings are in error. Accordingly, an error process is performed in step S18. The target temperature determination process terminates in Step S19.

Figure 11:
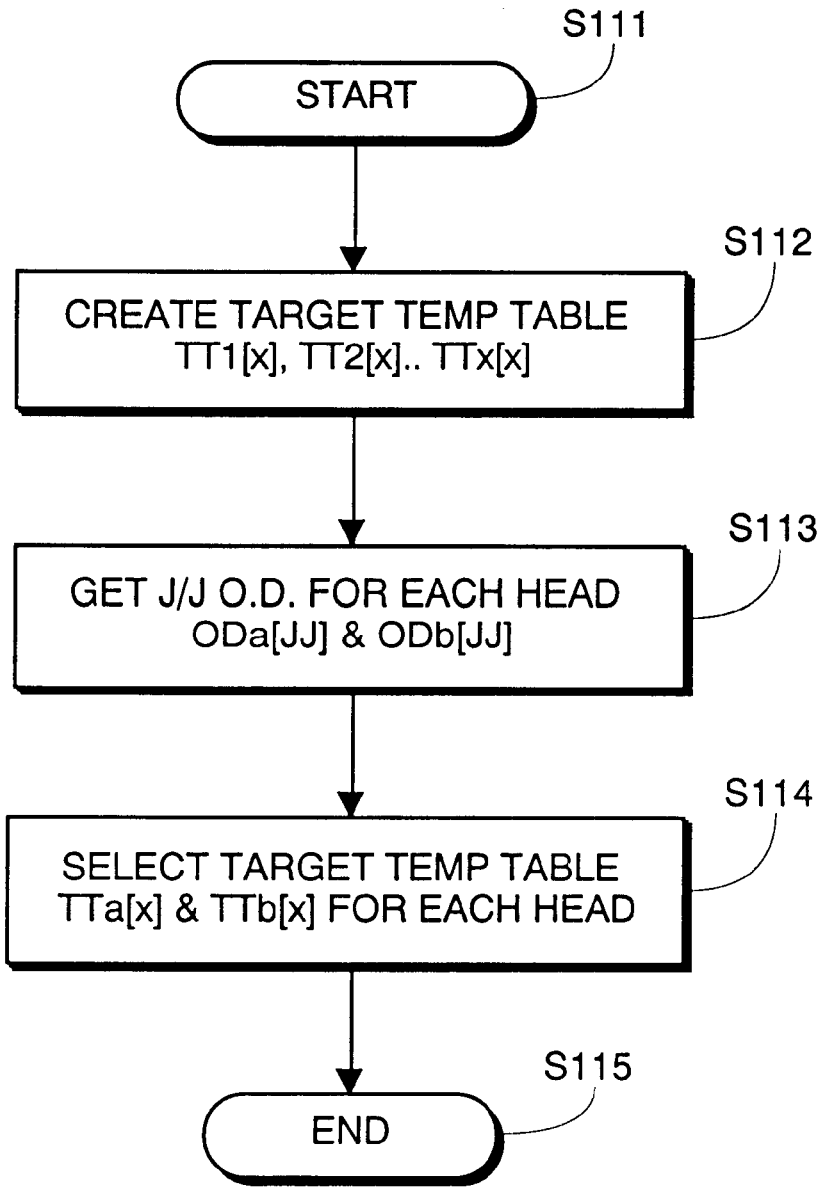
FIG. 11 is a flowchart describing a method for constructing a target temperature table according to the present invention.
Figure 12:
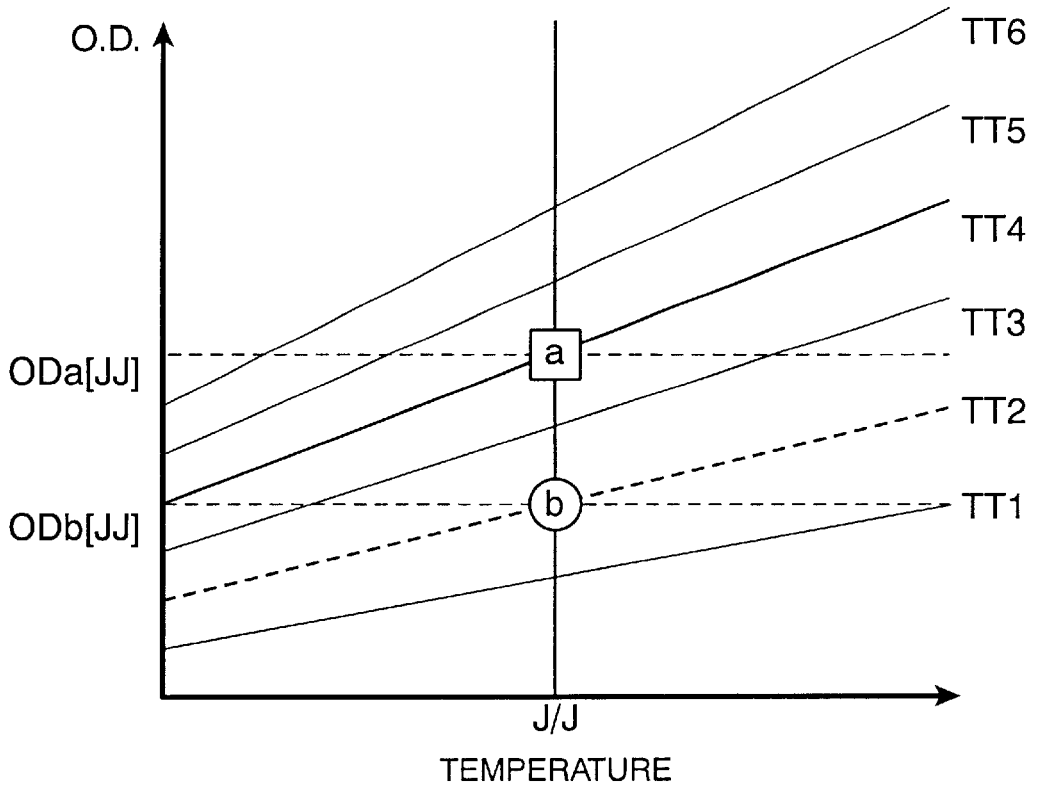
FIG. 12 is a graph illustrating a process for choosing a target temperature from a target temperature table according to the present invention.

FIG. 11 shows a flowchart for constructing a target temperature table to be utilized by the processes of FIG. 9 and FIG. 10. In step S112, output levels are measured as a function of temperature for each of multiple printheads, and temperature-output level tables of TT1[x], TT2[x], . . . , TTi[x] are built, where TTi[x] denotes the output level of the i-th printhead at temperature x. The measured data is illustrated in FIG. 12. It has been determined that, in step S112, printing data having a duty of less than 50% should be supplied to the printheads. In addition, it is preferable to choose printheads having different output levels at room temperature. The constructed target temperature tables are stored in Control ROM 23 in the printing device.

This preferred embodiment utilizes replaceable printheads. Therefore, the target table should include data for all printheads which might eventually be installed in the printing device. However, it may be preferable to reduce the total amount of stored data by consolidating data corresponding to printheads having similar temperature-output level characteristics.

In step S113, output levels Oda[JJ] and Odb[JJ] for installed printheads 4A and 4B are measured at room temperature at an appropriate time, such as when the printheads are installed, or when the power is turned on. Photosensor 31 measures these output levels on a test pattern printed using print data having the same duty as that used in step S112. Although either absolute or relative output levels can be measured, this preferred embodiment utilizes absolute values.

Steps S114 and S115 estimate the characteristics of each printhead based on the measured output levels and, based on the estimation, choose a table to manage the target temperatures. In the example shown in FIG. 12, characteristic TT4 is chosen for printhead 4A, and characteristic TT2 for printhead 4B. The data in the chosen tables are stored in RAM 22 as the target temperature tables for both heads 4A and 4B. Accordingly, a customized table such as that shown in FIG. 8 is constructed.

In a case where relative output level values are measured in step S113, the characteristic TT1 is assigned to the printhead having the lower output level and an output level characteristic TT2 to TT6 is assigned to the other printhead. When the room temperature measurement data does not match with any of TTi[JJ], the table having the most similar data, or the weighted average of two tables having similar data, one of which contains higher output levels and the other of which contains lower output levels, should be used.

In the above preferred embodiment, measurement of output levels is done after the printheads are installed in the printing device. The output level of a printhead can also be measured when the printhead is manufactured and the measured data can be stored in the printhead during manufacture. The output level information or specific ID information can be stored in a ROM provided in a printhead or the output level information can be stored using a hardwired pattern or resistors having specific values. After such a printhead is installed in a printing device, the stored data is accessed in order to determine the output level-temperature characteristic corresponding to the printhead.

Alternatively, a target temperature table may be constructed by a printing device once a printhead is installed in the printing device. In this case, printhead 4A is fixed at a temperature AO while printing a test pattern and printhead 4B prints multiple test patterns while its temperature is varied. In accordance with the foregoing descriptions, the temperature BO at which printhead 4B produces the same output level as that of printhead 4A at the temperature AO is determined to correspond to printhead 4A's temperature AO. This process is repeated at different temperatures of printhead 4A in order to complete the target temperature table. This process reduces errors caused by variations of the sensitivity of photosensors among printing devices.

Figure 13:
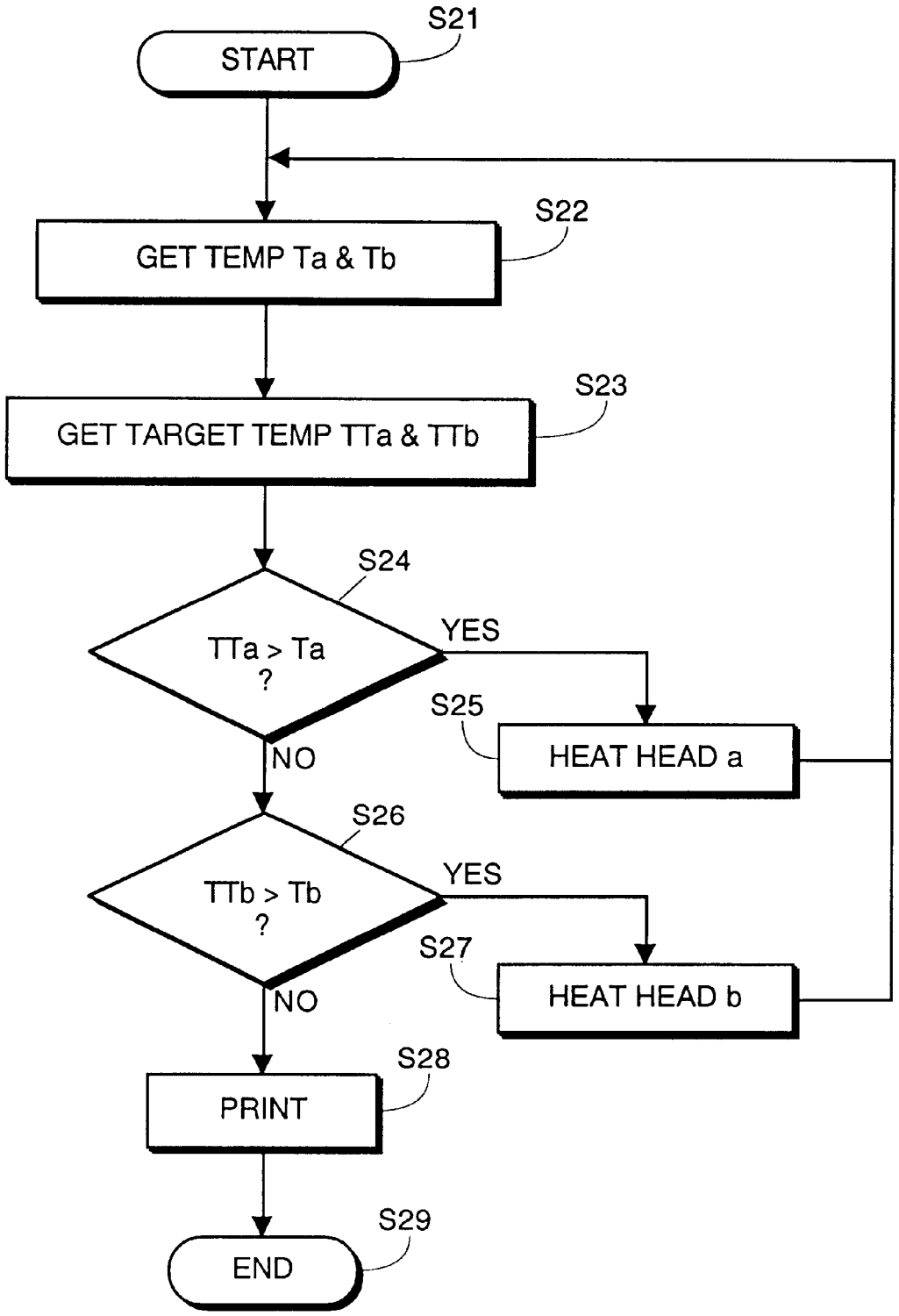
FIG. 13 is a flowchart describing temperature control during a printing operation according to the present invention.

FIG. 13 is a flowchart describing control of printhead temperature during printing. In step S22, CPU 21 obtains temperatures Ta and Tb of printheads 4A and 4B. Next, CPU 21 follows the flow of either FIG. 9 or FIG. 10 in order to obtain target temperatures TTa and TTb for each printhead. If, in step S24, temperature Ta is lower than target temperature TTa, flow proceeds to step S25, wherein printhead 4A is heated. On the other hand, if temperature Ta of printhead 4A is not lower than the target temperature TTa, and if, in step S26, the temperature Tb of printhead 4B is lower than the target temperature TTb, flow proceeds to step S27, wherein printhead 4B is heated.

The above steps are repeated until the temperatures of printheads 4A and 4B are greater than target values TTa and TTb, respectively. Thereafter, in step S28, actual printing starts.

In the example of FIG. 13, printing begins once all printheads reach their respective target temperatures. Accordingly, the image density of each divided printing section is consistent.

Figure 14:
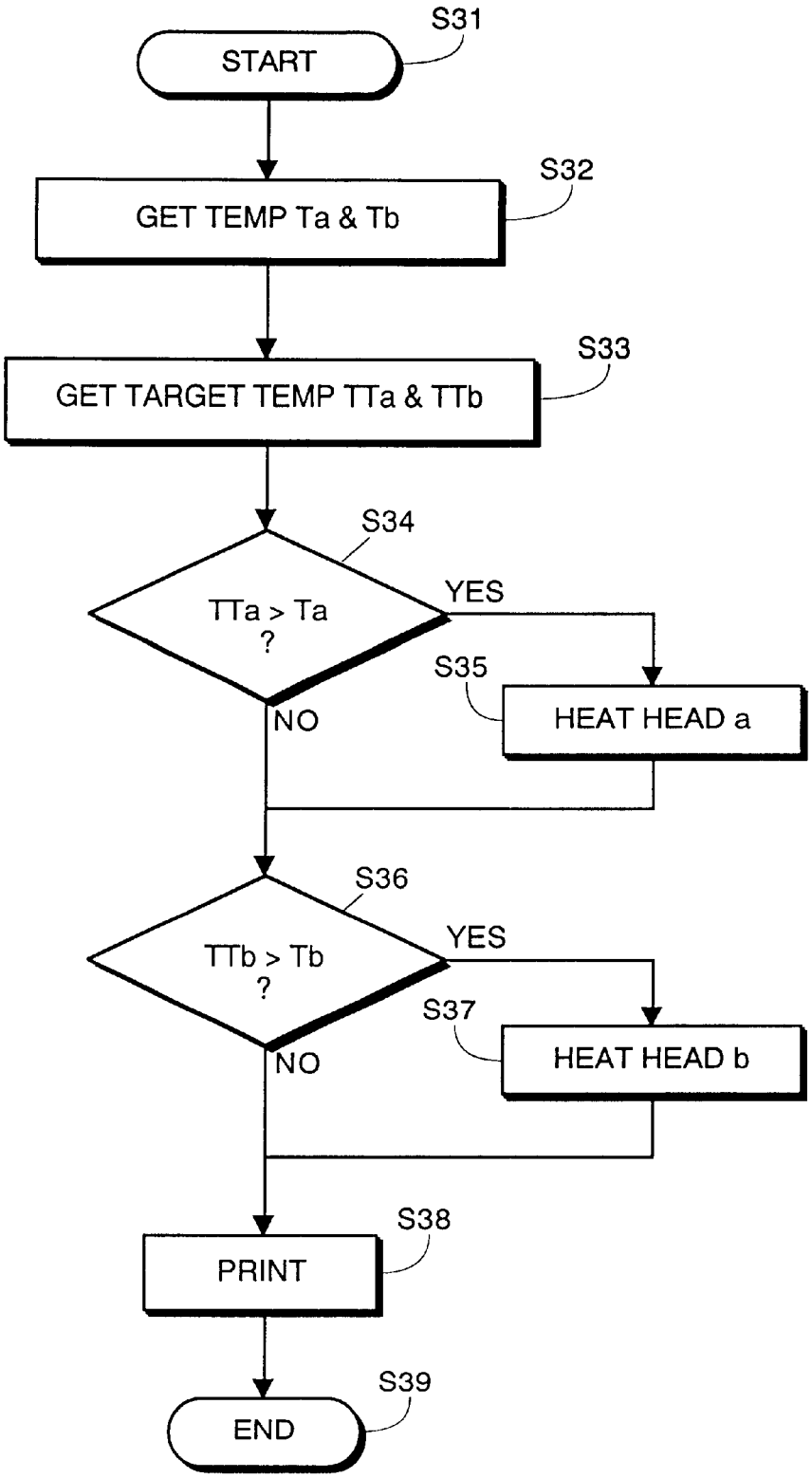
FIG. 14 is a flowchart describing a second method of temperature control during a printing operation according to the present invention.

The flowchart of FIG. 14 sets forth another printing control procedure. The actions performed at each step of FIG. 14 correspond to those steps in FIG. 13 having identical least-significant digits. Generally, the process of FIG. 14 differs from that of FIG. 13 in that printing is performed as soon as printhead 4A or printhead 4B is heated.

In other words, according to FIG. 14, printing begins without determining whether a heated printhead has reached its target temperature. Hence, the total printing time is less than that of the process in FIG. 13.

On the other hand, the image density in the divided printing sections of a document printed using the process of FIG. 14 may not be consistent because in some cases, printing may start before all printheads reach their target temperature. However, when printheads are always controlled toward a target temperature as provided in FIG. 14, actual printhead temperatures are not likely to vary greatly from the target temperatures.

As described above, this preferred embodiment increases the temperature of a printhead having a lower output level based on the temperature of a printhead having a higher output level in order to adjust the output level of the first printhead to the output level of the other printhead. Accordingly, the density difference between divided printing sections of a page is reduced even in a case where the temperatures of printheads fluctuate.

In this preferred embodiment, an entire printing area is divided into two sections and each of two printheads print in an assigned printing section. The present invention, however, is not limited to this arrangement. It can be applied to cases in which an entire printing area is divided into three or more printing sections and in which three or more printheads print in each of the assigned printing sections.

For example, FIG. 15 shows a target temperature table for a case in which an entire printing area is divided into three printing sections and in which three printheads print in each of the three sections. In such a case, based on the temperature of a printhead having the highest output level, the temperature of the other two printheads are adjusted so that both produce the same output level as the printhead having the highest output level.

In the above preferred embodiment, temperature sensors 46 measure the temperature of the printheads. Other well-known methods may also be utilized to estimate the printhead temperatures. For example, printhead temperature variations can be estimated from the duty of the driving signals supplied to the printheads, and the net printhead temperatures can be estimated using the temperature variation estimates and a temperature measured within a printing device by an environment sensor. With this arrangement, and contrary to the above embodiment, differences in measured printhead temperatures will not be affected by differences among individual temperature sensors used to measure individual printhead temperatures.

In the above preferred embodiment, control is performed by CPU 21 using stored process steps. Alternatively, printer driver 103 in a host computer can perform the control. In this case, printer driver 103 is designed to contain a target management table, and to receive temperature information of multiple printheads. For example, printer driver 103 follows the flow of FIG. 9 or FIG. 10 to obtain the target temperature for one of the printheads using the received temperature information. Printer driver 103 then transmits the target temperature information to a printing device. The printing device receives the target temperature information and follows the flow of FIG. 13 or FIG. 14 in order to perform the temperature control.

It may be advantageous to incorporate the above-mentioned temperature estimation method when utilizing printer driver 103 as described above because printer driver 103 can estimate the temperature of the printheads based on the printing data which the printer driver 103 itself transmits to the printing device. Printer driver 103 can also easily obtain the environment temperature from the printing device periodically.

Furthermore, this preferred embodiment utilizes temperature control heaters 47 in order to control printhead temperatures. Instead, cooling methods such as one utilizing Peltier devices can be used. In this case, the temperature of a printhead having a higher output level should be adjusted so that its output level equals that of another printhead having a lower output level. Both heating and cooling devices may also be used, based on the amount of heating or cooling necessary to equalize output levels.

The Second Preferred Embodiment

According to the second preferred embodiment, printhead 4B ejects lower density ink than that ejected by printhead 4A. Therefore, printheads 4A and 4B use inks having different concentration and also work together to print a gradient image in overlapped printing area "154 mm".

As described above, because the printing data transmitted to printhead 4A will usually differ from that transmitted to printhead 4B, the respective temperatures of printheads 4A and 4B may also differ. Because ink viscosity reduces when printhead temperature increases, the amount of ink ejected from the hotter printhead increases and the image produced therefrom becomes darker. Thus, the linearity of the gradient image is not easily maintained.

The thin solid lines labeled high-cyan and low-cyan in FIG. 16A show respective output levels for printheads 4A and 4B. The output levels of the two printheads are originally set to have a particular relationship by using a well-known output level compensation method such as pulse signal compensation or printhead temperature compensation. For convenience sake, the output levels for the high-density and low-density inks are drawn using equally thin lines. Both inks overlap in the printed image, therefore the thicker solid line indicates the net output level.

FIG. 16B illustrates the case in which the printing data duty for printhead 4A, the printhead having the high-density ink, is high. The output level of printhead 4A (shown by the thinner broken line) is greater than the original high-cyan output level of FIG. 16A. When printing is performed under the conditions of FIG. 16B, the actual combined output level (shown by the thicker broken line) increases non-linearly at a point in the high output level range. Thus, the linearity of the gradient is not maintained.

Therefore, in order to maintain the original output level relationship with printhead 4A, it is necessary to increase the output level of printhead 4B, as illustrated by the thinner broken lines in FIG. 16C. If increased as shown, the linearity of the gradient (the thicker solid line) can be re-established.

Contrary to FIG. 16A, FIG. 16B, and FIG. 16C, FIG. 17A and FIG. 17B illustrate a case in which the printing data duty to printhead 4B, having the lower-density ink, increases with respect to the printing data duty to printhead 4A. Similarly to the remedy shown in FIG. 16C, FIG. 17C shows that, in order to maintain the linearity of the gradient, the output level of printhead 4A must be increased.

Controlling the output levels shown in FIG. 16 and FIG. 17 occurs in a similar fashion to the control described in the first preferred embodiment. However, a target temperature table such as shown in FIG. 8 cannot be used without modification because the original concentration of the ink is different for printheads 4A and 4B. In this second preferred embodiment, the output level of the high-density ink is twice as much as that of the low-density ink. The target temperatures must therefore be defined so that this original relationship is maintained. Therefore, as illustrated in FIG. 18, the temperature-output level characteristics are measured separately for printhead 4A, having high-density ink, and printhead 4B, having low-density ink. The target temperature table is therefore constructed so that a given output level of the high-density ink corresponds to an output level of the low-density ink having one-half the magnitude of the given output level. As shown in FIG. 18, the respective printhead temperatures at which this circumstance occurs are designated as corresponding to one another.

It is also possible to utilize the table in FIG. 8 to construct the table of FIG. 18. In doing so, the target temperatures are obtained by comparing corrected output levels. The corrected printhead temperatures are obtained by determining each temperature at which the output level of printhead 4B is a desired fraction of each output level of printhead 4A.

As described above with respect to FIGS. 13 and 14, in this preferred embodiment, CPU 21 increases the temperature of a printhead having a lower output level than that required for a particular output level relationship. Hence, regardless of which printhead fluctuates in temperature, the gradient linearity within an overlapped printing area can be maintained.

Furthermore, the design of this invention is not limited to a shuttle type printing device. It can be applied to any serial-type or full-multi-type gray scale printing device.

In addition, the various alterations explained with respect to the first preferred embodiment are also applicable to this second preferred embodiment. For example, the various method of construction of a target temperature table, printhead temperature estimation, and control by printer driver 103 can all be applied to this preferred embodiment.

The Third Preferred Embodiment

In the above-described first and second preferred embodiments, each printhead ejects inks for each of four colors. Even if the printing data duty is very different among the four colors, the amount of ejected ink does not differ greatly among the four colors because ink jet nozzles for all colors are formed on the same substrate and therefore the four inks are all at the same temperature.

In the third preferred embodiment, an independent printhead is provided for each of the four colors, black, yellow, magenta and cyan. The printheads basically have a similar structure as the one shown in FIG. 3. However, each printhead contains 128 units of heater 41.

In this example, a black image in the lower density range is printed, not by a black ink, but by the PCBk (Process Color Black), which utilizes the combination of yellow, magenta and cyan. In a higher density range, a black image is expressed by all four colors.

In FIG. 19, lines A to D correspond to each of the printheads containing black, yellow, magenta and cyan inks, respectively. Print data transmitted to each of printheads A to D usually differs from that of each other printhead, and therefore, in some cases, the temperature of each of the printheads A to D differs from that of each other printhead.

As described above, when the printhead temperature increases, the viscosity of ink reduces and more ink is ejected. Thus, the image density corresponding to the less-viscous ink increases. As a result, a desired color balance and gray balance may be lost.

The solid lines in FIG. 19A represent original output levels of printheads A to D. The output levels are originally fixed at a certain relationship by a well-known output level compensation method such as pulse signal compensation or printhead temperature compensation. Ink ejected from each printhead is combined on a printed image and creates an image having the PCBk output level represented by the thick solid line PCBk.

In FIG. 19B, the duty of printing data for the cyan ink printhead, or printhead 4B, is high and, therefore, the output level of printhead 4B (the thin broken line) is greater than the level needed to maintain its original relationship with the output from printheads A, C and D. Therefore, when printing is performed under the conditions of FIG. 19B, the resultant hue becomes different from the hue of FIG. 19A.

Accordingly, it is necessary to increase the output levels of printheads C and D to the level represented by the thin broken lines C and D of FIG. 19C, so as to maintain the original output level relationship with printhead 4B. As a result of doing so, a deviation in hue can be corrected.

The output level for PCBk is shown in FIG. 19B and FIG. 19C as a reference only. Although PCBk is not linear in either Figure, it should be noted that this preferred embodiment is intended to maintain a particular hue or color balance, and not to maintain the linearity of the PCBk output level.

Figure 20:
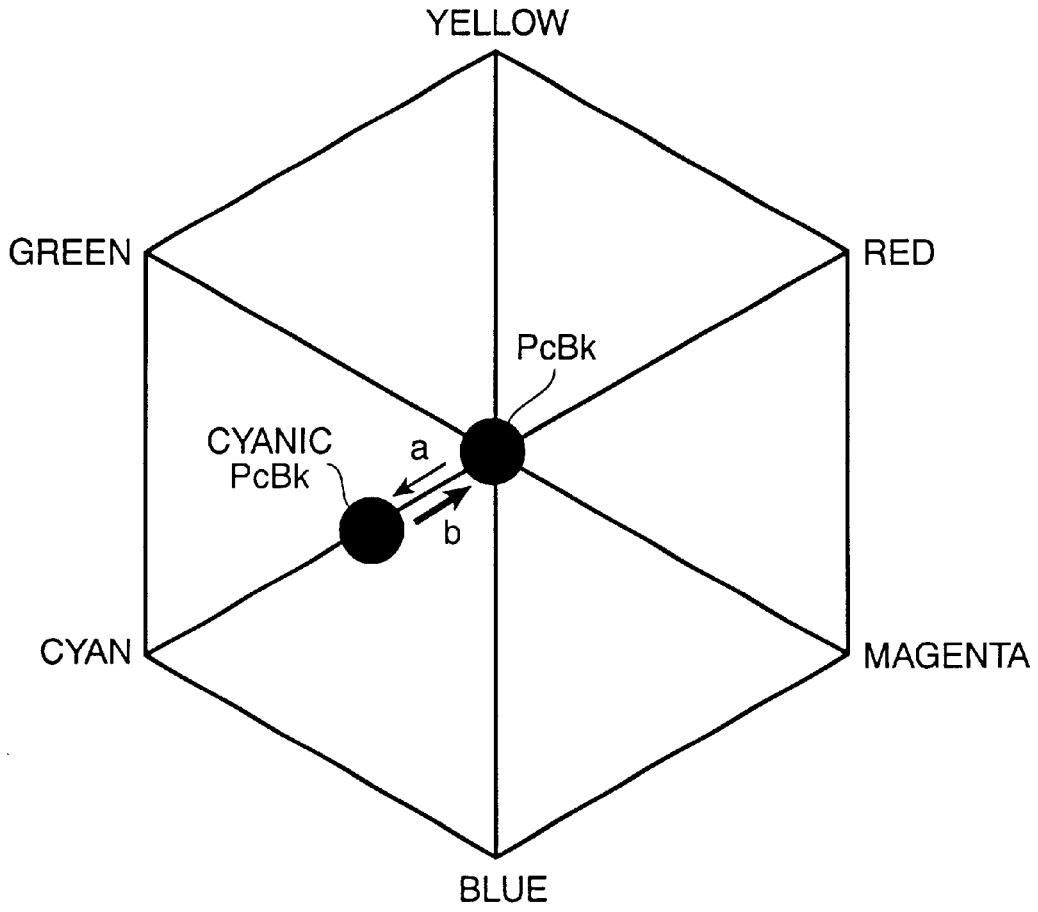
FIG. 20 shows a hue diagram for explaining a color compensation method according to the present invention.

This distinction is further explained by the hue diagram of FIG. 20. This hue diagram is created by dissecting a color space at a certain black output level. originally, the balance among CMY is chosen so that the expected black PCBk can be obtained. FIG. 19A illustrates a situation in which the output levels of each color satisfy the chosen balance. If one of the printheads, for example, the cyan-ejecting printhead, exhibits a rise in temperature, then its color output level increases as illustrated in FIG. 19B and the output shifts to a color having a hue deviation from the expected black, namely to a black having a strong cyan hue (cyanic PCBk), as shown by arrow in FIG. 20. Accordingly, this hue deviation is corrected by adjusting the other two colors as shown in FIG. 19C so as to obtain the expected black.

The correction is illustrated by arrow b of FIG. 20.

Once this correction is performed, the CMY level as a whole increases with respect to that of black. The PCBk output level therefore increases in the medium output level range, as illustrated in FIG. 19C. Accordingly, it may also be necessary to adjust the output level of printhead 4A, having the black ink, in order to maintain the gradient of the PCBk. This adjustment is the same as the compensation of the black output level for the black in the medium and high output levels, or the compensation for the gray scale printing in black color. Hence, the explanation is omitted here.

In this preferred embodiment, the target temperature table shown in FIG. 21 is prepared in order to define the target temperatures for printheads of two colors when an output level of a third printhead increases.

The table of FIG. 21 is constructed at room temperature using the previously-described methods. Then, for a certain temperature of one of the printheads, the temperatures for the other two printheads are obtained so that the resultant outputs form black when mixed. The K-CMY target temperature tables, TTc[K], TTm[K], and TTy[K], are constructed so as to produce a black output level of ½K, or one-half of the black output level of the black ink-ejecting printhead after the temperature adjustments are completed. It is desirable to construct these tables at a CMY balance corresponding to 50% of the output level of the black printhead because such a construction gives the best compensation efficiency.

Figure 22:
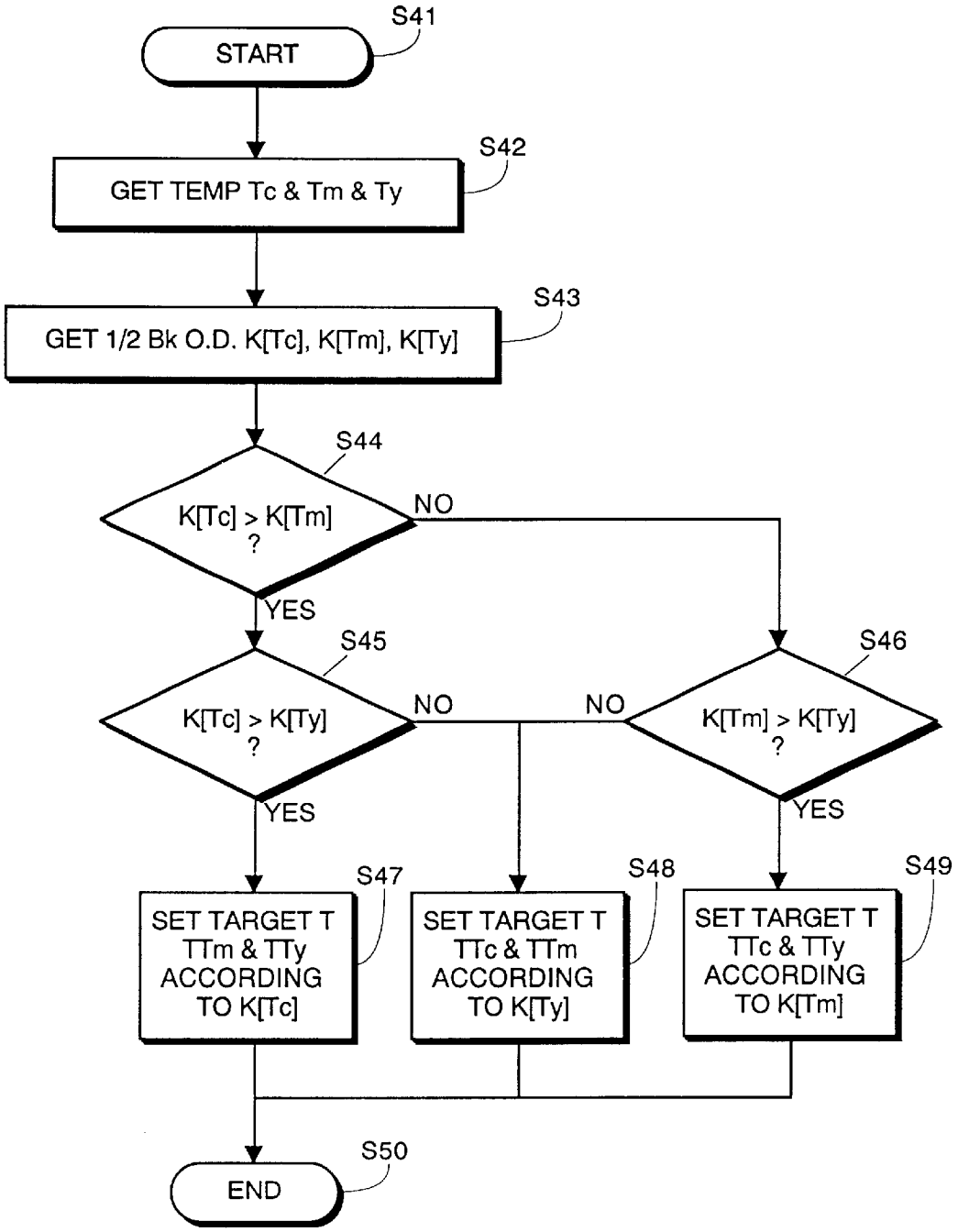
FIG. 22 is a flowchart which illustrates a process to obtain target temperatures for color printing according to the present invention.

The flowchart of FIG. 22 describes a method for obtaining target temperatures according to the third preferred embodiment of the present invention.

In step S42, CPU 21 obtains the temperatures Tc, Tm and Ty for three printheads using temperature sensor 46 provided on each printhead. At step S43, CPU 21 obtains, using the table of FIG. 21, black output levels K[Tc], K[Tm] and K[Ty], which correspond, respectively, to the printhead temperatures Tc, Tm and Ty. For example, when the temperature Tc of printhead C is CQ, Tm of printhead M, MP, and Ty of printhead Y, YP, then the black output levels K[Tc], K[Tm] and K[Ty] for printheads C, M, and Y are Q, P, and P, respectively.

At steps S44 to S46, the highest black output level is determined from among K[Tc], K[Tm] and K[Ty]. If the corresponding black output level K[Tc] is the highest, then, in step S47, CPU 21 uses the table to determine the values of the target temperatures TTm and TTy needed for printheads M and Y (in this example, MQ and YQ). If black output level K[Tm] is the highest, then, in step S49, the values of the target temperatures TTc and TTy for printheads C and Y are determined. The temperature control process following S50 is the same as that shown in FIG. 13 and FIG. 14. Hence, it is omitted here.

As described above, in this preferred embodiment, the temperature of a printhead producing a lower black output level than that required for a particular output level relationship is adjusted. The temperature is adjusted based on the output level required for the particular output level relationship. Therefore, no matter which printhead fluctuates in temperature, a particular color balance can be maintained.

Furthermore, the design of this embodiment is not limited to a shuttle type printing device. It can be applied to any serial-type or full-multi-type gray scale printing device.

In addition, the various alterations explained with respect to the first preferred embodiment are also applicable to this preferred embodiment. In particular, the construction of a target temperature table, printhead temperature estimation, and control by printer driver 103 can all be incorporated into this embodiment.

The Fourth Preferred Embodiment

The fourth preferred embodiment includes one printhead to eject black ink and another to eject yellow, magenta and cyan inks separately. The printheads have a structure similar to the printhead of FIG. 3. However, the printhead to eject black ink contains 128 heaters 41, while the printhead to eject yellow, magenta and cyan inks contains 160 heaters 41. Forty-eight heaters are dedicated to each color and each of the two regions between the ink colors contains 8 heaters.

In this example, a black image in a lower density range is printed, not by a black ink, but by PCBk (Process Color Black). In the higher density range, a black image is printed using the PCBk and black ink.

In the third preferred embodiment, all four color printheads are separate and hence, temperature fluctuation for each ink occurs somewhat independently. In this preferred embodiment, one color printhead contains three color inks, and therefore, it is considered that the same temperature fluctuation occurs to each of the three colors. Therefore in this preferred embodiment, gray balance is more of a concern than color balance.

In the following description, A denotes the printhead with black ink and B denotes the printhead having color ink. Because printheads 4A and 4B are separate entities, the output levels of black for printhead 4A and of color for printhead 4B fluctuate independently. Printing data transmitted to each of printheads 4A and 4B differs from that of the other for many images, and hence, in some cases, the temperature of each of the printheads 4A and 4B differs from that of the other. When the temperature of a printhead increases, the viscosity of its ink reduces and more ink is ejected. As a result, the gray balance cannot be maintained, as in the case with the third preferred embodiment.

The solid lines in FIG. 23A represent the output levels of printheads 4A and 4B. The output levels of the printheads are originally set at a certain relationship by a well-known output level compensation method such as the pulse signal compensation method or the printhead temperature compensation method. Ink ejected from each printhead is combined on a printed image and, as a result, the image has the PCBk output level, which is represented by the thick solid line in the Figure.

In FIG. 23B, the duty of printing data for the black ink printhead, or printhead 4A, is high and the output level of printhead 4A (the thinner broken line) is greater than the level required for the original relationship with printhead 4B. When printing is performed under this condition, the output level in the high density range is greater than it should be (thicker broken line) and hence, as described above, the gray balance cannot be maintained.

Therefore, it is necessary to increase the output level of printhead 4B to the level represented by a thinner broken line in FIG. 23C, so that the original output level relationship with printhead 4A can be maintained. As a result, the proper gray balance (thick solid line) can be restored.

Contrary to FIG. 23A to FIG. 23C, FIG. 24A to FIG. 24C show the case in which the duty of printing data for printhead 4B increases with respect to that for printhead 4A. As shown in FIG. C, the gray balance is restored by increasing the output level of printhead 4A.

As in the case of the above-explained second preferred embodiment, the target temperatures in this preferred embodiment can be obtained by comparing corrected output levels. The corrected output levels are obtained based on a certain constant relationship required between the black ink output level and the PCBk output level.

As described above with respect to FIG. 13 and FIG. 14, the temperature of a printhead with a lower output level than that required for a particular output level relationship is increased to achieve the particular output level relationship. Therefore, no matter which printhead fluctuates in temperature, the gray balance in color printing can be maintained.

Furthermore, the design of this invention is not limited to a shuttle type printing device. It can be applied to any serial-type or full-type gray scale printing device.

In addition, the various alterations explained in the first preferred embodiment are also applicable to this preferred embodiment. For example, the construction of a target temperature table, printhead temperature estimation, and control by printer driver 103 are all applicable to this preferred embodiment.

In addition, this invention is not restricted to an image printing instrument in which binary data is printed. This invention is also effective for a printing device which prints multiple-level image data. Furthermore, the series of signal processing may all be performed by a printer driver.

This invention is applicable, not only to the ink jet printing method, but also to the printing methods in which the print density has thermal characteristics, such as the above-mentioned thermal melt and sublimation transfer printing methods.

The invention is also applicable to printing devices which use paper, cloth, leather, transparencies, metal or other types of print media.

While the present invention is described above with respect to what is currently considered to be its preferred embodiments, it is to be understood that the invention is not limited to the disclosed embodiments. To the contrary, the invention is intended to cover various modifications and equivalent arrangements included within the spirit and scope of the appended claims.

What is claimed is:

1. A method for controlling output levels of an image printing device having multiple printheads comprising the steps of:

obtaining a temperature of each of the multiple printheads;

determining, based on the obtained temperature of one of the multiple printheads, target temperatures for each other of the multiple printheads in order to maintain a predetermined relationship between an output level of the one of the multiple printheads and an output level of each other of the multiple printheads;

adjusting the temperature of each other of the multiple printheads using its determined target temperature; and printing an image using the multiple printheads.

2. A method according to claim 1, wherein said determining step determines the target temperature corresponding to each other of the multiple printheads so that an output level of an image printed by the one print head is equal to an output level of an image printed by each other of the multiple printheads.

3. A method according to claim 1, wherein each of the multiple printheads uses a different color ink to print an image, and wherein said determining step determines the target temperature corresponding to each other of the multiple printheads in order to maintain a predetermined color balance between an image printed by the one printhead and an image printed by each other of the multiple printheads.

4. A method according to claim 1, wherein each of the multiple printheads uses a different color ink to print an image, one of the inks being black ink, and wherein said determining step determines the target temperature corresponding to each other of the multiple printheads in order to maintain a predetermined gray balance between an image printed by the one printhead and an image printed by each other of the multiple printheads.

5. A method according to claim 1, wherein each of the multiple printheads uses ink of a density different than a density of ink used by any other of the multiple printheads, and wherein the determining step determines the target temperature corresponding to each other of the multiple printheads in order to maintain a particular gradient balance between an image printed by the one printhead and an image printed by each other of the multiple printheads.

6. A printing device having multiple printheads, comprising:

an acquisition device to obtain a temperature of each of the multiple printheads;

a determination device which determines, based on the obtained temperature of one of the multiple printheads, target temperatures for each other of the multiple printheads in order to maintain a predetermined output level relationship between an output level of the one printhead and an output level of each other of the multiple printheads; and an adjustment device to adjust the temperature of each other of the multiple printheads using its target temperature.

7. A printing device according to claim 6, wherein said determination device determines the target temperature corresponding to each other of the multiple printheads so that an output level of an image printed by the one printhead is equal to an output level of an image printed by each other of the multiple printheads.

8. A printing device according to claim 6, wherein each of the multiple printheads uses a different color ink to print an image, and wherein said determination device determines the target temperature corresponding to each other of the multiple printheads in order to maintain a predetermined color balance between an image printed by the one printhead and an image printed by each other of the multiple printheads.

9. A printing device according to claim 6, wherein each of said multiple printheads uses a different color ink to print an image, one of the inks being black ink, and wherein said determination device determines the target temperature corresponding to each other of the multiple printheads in order to maintain a predetermined gray balance between an image printed by the one printhead and an image printed by each other of the multiple printheads.

10. A printing device according to claim 6, wherein each of the multiple printheads uses ink of a density different than a density of ink used by any other of the multiple printheads, and wherein said determination device determines the target temperature corresponding to each other of the multiple printheads in order to maintain a predetermined gradient balance between an image printed by the one printhead and an image printed by each other of the multiple printheads.

11. A printing device according to claim 6, wherein said determination device comprises temperature sensors installed on each of the multiple printheads.

12. A printing device according to claim 6, wherein said determination device comprises:

environment temperature sensors installed within said printing device; and an estimation device to estimate the temperature of each of the multiple printheads based on an environment temperature measured by said environment temperature sensors and a duty of printing data supplied to each of the multiple printheads.

13. A printing device according to claim 6, wherein the multiple printheads are disposed at a fixed distance from each other along a scanning direction.

14. A printing device according to claim 13, wherein the multiple printheads use identically-colored inks, and wherein each of the multiple printheads prints in one of assigned sections of a print area, the assigned sections dividing the print area along the scanning direction.

15. A printing device according to claim 14, wherein said determination device determines the target temperature corresponding to each other of the multiple printheads in order to maintain a predetermined output level relationship between an image printed by the one printhead and an image printed by each other of the multiple printheads.

16. A printing device according to claim 6, wherein each of the multiple printheads uses ink of a density different than a density of ink used by any other of the multiple printheads, and wherein the multiple printheads cooperate with each other to print a gradient image in an overlapped printing area, the overlapped printing area being an area in which individual printhead scanning regions overlap in a scanning direction.

17. A printing device according to claim 16, wherein said determination device determines the target temperature corresponding to each other of the multiple printheads in order to maintain a predetermined gradient balance between an image printed by the one printhead and an image printed by each other of the multiple printheads.

18. A printing device according to claim 6, wherein said determination device comprises temperature-output level tables corresponding to the obtained temperatures of the multiple printheads.

19. An image printing device according to claim 18, wherein said determination device (1) obtains, from the temperature-output level tables, an output level of each of said multiple printheads which corresponds to the obtained temperature of each of said multiple printheads, (2) determines the maximum output level among the obtained output levels, (3) obtains, from the temperature-output level tables, a temperature for each of said multiple printheads which corresponds to the obtained maximum output level, and (4) defines the obtained temperatures as target temperatures of said multiple printheads.

20. A printing device according to claim 6, wherein said determination device comprises temperature tables containing tentative target temperatures used to maintain a predetermined output level relationship between the multiple printheads.

21. A printing device according to claim 20, wherein said determination device (1) obtains, from said temperature tables, a tentative target temperature for each of said multiple printheads which corresponds to the obtained temperature of each of said multiple printheads, (2) finds a maximum target temperature among the obtained tentative target temperatures, and (3) defines the maximum tentative target temperature as the tentative target temperature for the printhead to which the maximum tentative target temperature corresponds.

22. A printing device according to claim 6, wherein said adjustment device comprises heating devices to heat the multiple printheads.

23. A printing device according to claim 6, wherein said adjustment device comprises cooling devices to cool the multiple printheads.

24. A printing device according to claim 6, wherein said printing device prints an image by using the multiple printheads after said adjustment device adjusts the temperatures of each other of the multiple printheads to the determined target temperatures.

25. A printing device according to claim 6, wherein said printing device prints an image by using the multiple printheads at a time after said adjustment device begins adjustment of the temperatures of each of the multiple printheads to the determined target temperatures and before said adjustment device completes adjustment of the temperatures of each of the multiple printheads to the determined target temperatures.

26. A printing device according to claim 6, wherein the multiple printheads use heat to eject ink jets.

27. A printer driver installed in a host computer, the printer driver comprising:

computer-executable acquisition code to acquire temperatures of multiple printheads installed in a printer; and computer-executable determination code to determine, based on the acquired temperature of one of the multiple printheads, target temperatures for each other of the multiple printheads in order to maintain a predetermined output level relationship between an output level of the one printhead and an output level of each other of the multiple printheads.

28. A printer driver according to claim 27, wherein said determination code is to determine the target temperature corresponding to each other of the multiple printheads so that an output level of an image printed by the one printhead is equal to an output level of an image printed by each other of the multiple printheads.

29. A printer driver according to claim 27, wherein each of the multiple printheads uses a different color ink to print an image, and wherein said determination code is to determine the target temperature corresponding to each other of the multiple printheads in order to maintain a predetermined color balance between an image printed by the one printhead and an image printed by each other of the multiple printheads.

30. A printer driver according to claim 27, wherein each of the multiple printheads uses a different color ink to print an image, one of the inks being black ink, and wherein said determination code is to determine the target temperature corresponding to each other of the multiple printheads in order to maintain a predetermined gray balance between an image printed by the one printhead and an image printed by each other of the multiple printheads.

31. A printer driver according to claim 27, wherein each of the multiple printheads uses ink of a density different than a density of ink used by any other of the multiple printheads, and wherein said determination code is to determine the target temperature corresponding to each other of the multiple printheads in order to maintain a particular gradient balance between an image printed by the one printhead and an image printed by each of the other multiple printheads.

32. A printer driver according to claim 27, wherein said acquisition code is to acquire temperatures measured by temperature sensors installed on the multiple printheads.

33. A printer driver according to claim 27, wherein said acquisition code is to acquire temperatures measured by temperature sensors installed in the printer, and is to obtain the temperature of each of the multiple printheads based on the measured temperatures and a duty of printing data supplied to each of the multiple printheads.

34. A printer driver according to claim 27, further comprising computer-executable transmission code to transmit printing data to the multiple printheads.

35. A method according to claim 1, wherein said determining step comprises examining a pre-stored temperature-output level table corresponding to at least one of the multiple printheads.

36. A printer driver according to claim 27, wherein said computer-executable determination code is to determine the target temperature in conjunction with a pre-stored temperature-output level table corresponding to at least one of the multiple printheads.

* * * * *

UNITED STATES PATENT AND TRADEMARK OFFICE

CERTIFICATE OF CORRECTION

PATENT NO. : 6,283,650 B1
DATED : September 4, 2001
INVENTOR(S) : Akitoshi Yamada et al.

It is certified that error appears in the above-identified patent and that said Letters Patent is hereby corrected as shown below:

Column 3,
Line 41, "FIG. 6, comprising FIG. 6A and FIG. 6B," should read -- FIG. 6 comprises FIG. 6A and FIG. 6B, which --.

Column 5,
Line 23, "at" should read -- as --.
Line 55, "an" should read -- in an --.

Column 7,
Line 35, "improve" should read -- improves --.

Column 8,
Line 56, "FIG. 6A" should read -- FIGS. 6A --.
Line 58, "FIG. 6A" should read -- FIGS. 6A --.
Line 60, "O." should read -- O --.

Column 9,
Line 23, "0," should read -- O, --.

Column 14,
Line 39, "method" should read -- methods --.

Column 15,
Line 46, "left margin should be closed up.

Column 18,
Line 20, "printheads" should read -- printheads, --.
Line 36, "print head" should read -- printhead --.

Column 19,
Line 13, "target" should read -- determined target --.

UNITED STATES PATENT AND TRADEMARK OFFICE

CERTIFICATE OF CORRECTION

PATENT NO. : 6,283,650 B1
DATED : September 4, 2001
INVENTOR(S) : Akitoshi Yamada et al.

It is certified that error appears in the above-identified patent and that said Letters Patent is hereby corrected as shown below:

Column 21,
Line 8, "eject" should read -- eject ink from --.

Signed and Sealed this

Thirteenth Day of August, 2002

*Attest:*

*Attesting Officer*

JAMES E. ROGAN
*Director of the United States Patent and Trademark Office*